US007587773B2

(12) United States Patent
Littlehorn et al.

(10) Patent No.: US 7,587,773 B2
(45) Date of Patent: Sep. 15, 2009

(54) NURSING SUPPORT PILLOWS AND METHODS

(75) Inventors: Sheila Littlehorn, Littleton, CO (US); Kristin A. Tidwell, Denver, CO (US); Elizabeth A. Franqui, Philadelphia, PA (US)

(73) Assignee: The Boppy Company, LLC, Golden, CO (US)

( * ) Notice: Subject to any disclaimer, the term of this patent is extended or adjusted under 35 U.S.C. 154(b) by 376 days.

(21) Appl. No.: 11/330,760

(22) Filed: Jan. 11, 2006

(65) Prior Publication Data

US 2006/0162080 A1 Jul. 27, 2006

Related U.S. Application Data

(63) Continuation-in-part of application No. 11/169,600, filed on Jun. 28, 2005, now Pat. No. 7,331,073, which is a continuation-in-part of application No. 11/120,694, filed on May 2, 2005, which is a continuation-in-part of application No. 10/612,266, filed on Jul. 1, 2003, now Pat. No. 6,944,898.

(51) Int. Cl.
*A47G 9/00* (2006.01)

(52) U.S. Cl. ..... 5/655; 5/652; 5/657; 5/632

(58) Field of Classification Search ..... 5/632, 5/633, 640, 631, 630, 636, 653, 655, 657, 5/652, 930, 645

See application file for complete search history.

(56) References Cited

U.S. PATENT DOCUMENTS

| | | | | |
|---|---|---|---|---|
| 682,871 | A | 9/1901 | Hogan et al. | |
| 941,043 | A * | 11/1909 | Powell | 5/640 |
| 1,343,357 | A | 6/1920 | Eggers | |
| 1,386,652 | A * | 8/1921 | Patton | 5/640 |
| 1,986,697 | A | 1/1935 | Wilson | |

(Continued)

FOREIGN PATENT DOCUMENTS

DE 42 05 650 A1 11/1993

(Continued)

OTHER PUBLICATIONS

Leachco Adjustable Nursing Pillow, http://store.yahoo.com/leachco/naturalboost.html, May 16, 2005.

(Continued)

*Primary Examiner*—Robert G Santos
(74) *Attorney, Agent, or Firm*—Townsend and Townsend and Crew LLP

(57) ABSTRACT

A pillow system comprises a curved main pillow having a pillow body having a midsection and a pair of ends. The pillow body is curved and is both flexible and firm to permit it to wrap around a user. A curved side pillow is operably attached to one of the ends of the main pillow such that the side pillow is positionable around the user's side and back when the main pillow is placed adjacent to the user's stomach. The side pillow has an inner portion near the main pillow and an outer portion away from the main pillow. The side pillow tapers downward in height from the inner portion to the outer portion.

22 Claims, 19 Drawing Sheets

U.S. PATENT DOCUMENTS 2,328,871 A 9/1943 Woehler
2,765,480 A 10/1956 Mueller
2,952,856 A 9/1960 Ruff
2,961,668 A 11/1960 Hayes
3,312,987 A 4/1967 Emery
3,327,330 A * 6/1967 McCullough ..... 5/640
3,561,757 A * 2/1971 Schillig ..... 482/35
3,667,074 A 6/1972 Emery
3,848,281 A 11/1974 Mathews
3,911,512 A * 10/1975 Plate ..... 5/652
3,920,239 A 11/1975 White
4,161,794 A 7/1979 Darnfors
4,197,604 A 4/1980 Nakamura
D255,966 S 7/1980 Stadel
4,227,270 A 10/1980 Rivera
4,236,264 A 12/1980 Britzman
4,345,347 A 8/1982 Kantor
4,394,783 A * 7/1983 Simmons ..... 297/230.1
4,397,052 A 8/1983 Lund, III
4,434,513 A 3/1984 Welch
4,506,396 A * 3/1985 Ritchie et al. ..... 5/631
4,617,691 A 10/1986 Monti et al.
4,731,890 A 3/1988 Roberts
4,754,510 A 7/1988 King
4,783,866 A 11/1988 Simmons et al.
4,794,657 A * 1/1989 Avery ..... 5/632
4,858,259 A 8/1989 Simmons et al.
4,876,755 A * 10/1989 Parrish ..... 297/284.3
4,901,384 A 2/1990 Eary
4,905,330 A * 3/1990 Jacobs ..... 5/705
D306,948 S 4/1990 Zollinger
D307,369 S 4/1990 Zollinger
D315,845 S 4/1991 Lafley
5,029,350 A 7/1991 Edelson
D318,969 S 8/1991 Byrn
5,054,142 A 10/1991 Owens
5,056,533 A 10/1991 Solano
5,103,516 A 4/1992 Stevens
5,134,740 A 8/1992 Summer
5,154,649 A 10/1992 Pender
5,182,828 A 2/1993 Alivizatos
5,193,235 A 3/1993 Kircher
5,257,429 A 11/1993 Genis
5,261,134 A 11/1993 Mathews
5,313,678 A 5/1994 Redewill
D348,174 S 6/1994 Genis
D352,633 S 11/1994 Berggren
D360,554 S 7/1995 Righini
D368,823 S 4/1996 Cancellieri
5,515,563 A 5/1996 Chao
5,519,906 A 5/1996 Fanto-Chan
5,528,784 A 6/1996 Painter
5,546,620 A 8/1996 Mathews
5,581,833 A 12/1996 Zenoff
D377,881 S 2/1997 Watt
5,661,861 A 9/1997 Mathews
5,664,271 A * 9/1997 Bellavance ..... 5/632
5,702,153 A 12/1997 Pliska
D393,772 S 4/1998 Vingino
D395,782 S 7/1998 Weddle
5,790,999 A 8/1998 Clark
5,797,153 A 8/1998 Amioka
D416,159 S 11/1999 Porter
5,978,990 A 11/1999 Akey
5,979,981 A 11/1999 Dunne et al.
6,038,720 A 3/2000 Mathews et al.
6,047,420 A 4/2000 Priester et al.
6,052,848 A 4/2000 Kelly
6,055,687 A 5/2000 Mathews
6,079,067 A * 6/2000 Becker et al. ..... 5/655
D431,745 S 10/2000 Jackson
6,182,311 B1 * 2/2001 Buchanan et al. ..... 5/632
6,202,232 B1 3/2001 Andrei
6,233,767 B1 5/2001 Horowitz
6,279,185 B1 8/2001 Mathews
6,321,403 B1 11/2001 Mathews
D453,653 S 2/2002 Tunnell
6,354,665 B1 3/2002 Ross
6,394,554 B1 5/2002 Hingle
6,412,128 B1 7/2002 Mathews
6,434,770 B2 8/2002 Mathews Brown
6,453,493 B1 9/2002 Mathews Brown
6,463,608 B1 10/2002 Moe
6,484,337 B1 * 11/2002 Moe et al. ..... 5/652
6,487,737 B1 12/2002 Futagami
6,499,164 B1 12/2002 Leach
6,523,200 B2 2/2003 Brown
6,532,612 B2 3/2003 Mathews Brown
6,553,590 B1 4/2003 Leach
6,564,408 B2 5/2003 Van Vuuren
6,625,828 B2 9/2003 Brown
6,640,977 B2 11/2003 Matthews Brown et al.
6,651,282 B1 11/2003 Skoug et al.
6,658,681 B2 12/2003 Britto et al.
6,668,404 B2 12/2003 Lanteri
6,671,908 B2 1/2004 Brown et al.
6,685,024 B1 2/2004 Matthews
6,708,354 B1 * 3/2004 Carter et al. ..... 5/632
6,711,770 B1 3/2004 Owens et al.
6,751,817 B1 6/2004 Leach
6,754,924 B1 * 6/2004 Brady et al. ..... 5/655
6,760,934 B1 7/2004 Leach
6,763,539 B1 7/2004 Bartley et al.
6,779,211 B1 8/2004 Williams
6,795,990 B1 * 9/2004 Hutchinson D. C. ..... 5/632
6,810,545 B1 11/2004 Darling et al.
6,823,545 B1 * 11/2004 Davis ..... 5/630
6,842,925 B1 1/2005 Owens et al.
D503,062 S 3/2005 Nash
6,886,201 B1 * 5/2005 Weiss-Lohrei ..... 5/631
6,944,898 B2 9/2005 Matthews Brown et al.
7,000,273 B2 2/2006 Rivera-Wienhold et al.
7,089,639 B2 * 8/2006 Matthews Brown et al. .. 29/91.1
D527,937 S 9/2006 Aiken et al.
7,114,206 B2 10/2006 Leach
7,322,061 B2 * 1/2008 Carroll ..... 5/630
7,331,073 B2 * 2/2008 Littlehorn et al. ..... 5/655
7,404,222 B2 * 7/2008 Tidwell ..... 5/655
7,430,774 B2 * 10/2008 Littlehorn et al. ..... 5/655
2002/0014436 A1 2/2002 Mathews Brown
2002/0029422 A1 3/2002 Matthews
2004/0060116 A1 4/2004 Matthews Brown
2004/0154104 A1 8/2004 Brown et al.
2004/0200004 A1 10/2004 Brown et al.
2005/0223492 A1 10/2005 Littlehorn et al.
2005/0278853 A1 * 12/2005 Littlehorn et al. ..... 5/636
2006/0162080 A1 * 7/2006 Littlehorn et al. ..... 5/652
2007/0056110 A1 3/2007 Tuoriniemi et al.
2007/0067914 A1 3/2007 Littlehorn et al.
2007/0192961 A1 8/2007 Tidwell et al.
2007/0209115 A1 * 9/2007 Carroll ..... 5/636
2007/0226910 A1 * 10/2007 Tidwell ..... 5/655
2007/0271703 A1 * 11/2007 Matthews Brown et al. .... 5/636
2009/0007335 A1 * 1/2009 Tidwell ..... 5/652

FOREIGN PATENT DOCUMENTS

EP 1 306 034 A1 5/2003
FR 1.430.355 1/1966
FR 2 379 268 9/1978
GB 215848 5/1924
GB 1 508 809 4/1978
GB 2 198 341 A 6/1988
GB 2 205 236 A 12/1988

| | | | |
|---|---|---|---|
| WO | WO 02/21978 | A2 | 3/2002 |
| WO | WO 02/21979 | A1 | 3/2002 |
| WO | WO 02/28232 | A1 | 4/2002 |

OTHER PUBLICATIONS

Leachco, Positional Nursing Pillow, http://store.yahoo.com/leachco/13560.html, May 16, 2005.

Leachco Infant Support Cushion, http:/;/store.yahoo.com/leachco/lecuddler.html, Apr. 20, 2005.

Baby Supercenter, Deluxe Nurse 'N Play Pillow, http://www.babysupercenter.com/cgi-bin/webc.cgi/st_prod.html?p_prodid=13407&p_catid=&sid=5dy8u., Apr. 20, 2005.

Parents of Invention, Nurse n' Sleep, http://www.parentsofinvention.com/products/NurseSleep.htm., Apr. 20, 2005.

Simplicity for Children, Hugger with Vibration, http://www.simplicityforchildren.com/ourproducts/nursingpillows/9300PGH.htm, Apr. 20, 2005.

Touch For Life, Regular Hugster, http://www.touchforlife.biz/products/family/hugster.html, Apr. 20, 2005.

Luvee Baby Products, The Luvee Nursing Pillow, http://www.theluvee.com/, Apr. 20, 2005.

Luvee Baby Products, Nursing Pillow, http://www.theluvee.com/benefits.htm, Apr. 20, 2005.

My Brest Friend, Nursing Pillow, http://www.mybrestfriend.com/features.html, Apr. 20, 2005.

Peaceful Pea, The Nursing Nest, http://peacefulpea.com/nursing_nest.html, Apr. 20, 2005.

Pregnancy Store, Kozy Kushion Nursing Pillow, http://www.pregnancystore.com/kozy_kushion.htm, May 16, 2005.

Gershman, Maurice M.D., "Self-Adhering Nylon Tapes," Journal of A.M.A., vol. 168, No. 7. Oct. 18, 1958.

* cited by examiner

NURSING SUPPORT PILLOWS AND METHODS

CROSS-REFERENCES TO RELATED APPLICATIONS

This application is a continuation in part and claims priority from co-pending U.S. application Ser. No. 11/169,600, filed Jun. 28, 2005, which is a continuation in part of co-pending U.S. application Ser. No. 11/120,694, filed May 2, 2005, which is a continuation in part of U.S. application Ser. No. 10/612,266, filed Jul. 1, 2003, the complete disclosures of which are herein incorporated by reference.

BACKGROUND OF THE INVENTION

This invention relates generally to the field of pillows, and in particular to pillows that may be used to support various items. More specifically, the invention relates to pillows that may rest on a user's lap to help support the items, as well as supporting a user's lower back.

Pillows have a wide variety of uses. For example, pillows are used almost universally when sleeping to support the head. Pillows may also be used to support other things as well. One example of such a pillow is the Boppy® support pillow, commercially available from The Boppy Company. Examples of such pillows are also described in U.S. Pat. Nos. 5,261,134 and 5,661,861, the complete disclosures of which are herein incorporated by reference. One use for these pillows is to use the open well to support a baby or to be placed around a user.

This invention relates to other pillows having a wide variety of uses. These pillows are described more fully hereinafter.

BRIEF SUMMARY OF THE INVENTION

In one embodiment, the invention provides a pillow that comprises a pillow body having a midsection and a pair of ends. The pillow body is curved and has an average radius of curvature that is in the range from about 6 inches to about 16 inches. The pillow also has a length in the range from about 21 inches to about 42 inches. The pillow body is firm enough to support items while being sufficiently flexible to allow the pillow to be shaped around an object, such as the waist or stomach of a user.

The pillow may be used by placing the pillow on a user's lap. In so doing, the midsection may rest on the user's legs while being adjacent to the user's stomach. The curved pillow body permits the pillow to wrap about the user so that the ends are adjacent the user's sides. The radius of curvature is selected so that the pillow may conform to a wide variety of users of different sizes. By selecting an appropriate radius of curvature, the ends are spaced sufficiently far apart so that the pillow can fit around the user while also closely conforming to the user.

The pillow body may be constructed in a variety of ways. For example, the pillow body may comprise a fill material that is encased in a fabric cover. As another example, the pillow body may comprise an inflatable bladder. In one aspect, the pillow may also have a removable slip cover. The slip cover may have an opening to permit it to be placed over the pillow. A fastener, such as a zipper, may be used to close the opening.

In one aspect, the midsection of the pillow body may have an average width that is in the range from about 5 inches to about 10 inches, and an average height in the range from about 4 inches to about 9 inches. The ends may be rounded and may have an average width in the range from about 3 inches to about 10 inches and an average height in the range from about 1 inch to about 9 inches. The ends may also be spaced apart by a distance in the range from about 14 inches to about 28 inches.

One advantage of the pillow is that the ends may be manipulated so that they fit between the arms of a chair and the user's sides. In this way, the pillow may conveniently be used when sitting in a chair.

The pillow may also be used to support a variety of items. For example, the pillow may be used to hold a baby, such as when nursing or bottle feeding the baby, or simply to help hold the baby. Other examples include the holding of books, food, crafts and the like.

In some embodiments, a padded attachment member may be removably attached to the pillow to adjust the vertical height of the pillow. For example, the attachment member may be attached to the bottom side of the pillow and rest on a user's lap to elevate the top side of the pillow. Alternatively, the attachment member may be attached to the top side of the pillow. In this way, the same pillow may be adapted to people of different sizes or for different applications, such as when nursing a baby that rests on the pillow and/or the attachment member.

The attachment member may be attached to only a portion of the pillow body or to the entire pillow. For example, the attachment member may be attached to only one end or arm to slant or angle the pillow on a user's lap. In some cases, the attachment member may have a shape that is similar to some or all of the pillow, or in some cases, the entire pillow, such as one of the arms. Also, the attachment member could be folded over on itself to enable it to rest against all or only half of the pillow. In some cases, the attachment member may have a height in the range from about 1 inch to about 5 inches to adjust the height of the pillow. This height may be uniform over the length of the attachment member or may vary across the length.

A variety of coupling arrangements may be used to couple the attachment member to the pillow. For example, the coupling arrangement could be part of the attachment member and be configured to wrap around the pillow and attach to itself. As another option, the coupling arrangement could be part of the attachment member and the pillow. For instance, the attachment member may have one connector while the pillow has a mating connector. Such connectors could include snaps, buttons, loops, ties, clips and the like.

Any of the pillows and/or attachment members described herein may be used in combination with one or more auxiliary pillows, also sometimes referred to as lower back or side pillows, that are used to support the user's lower back or be placed against the user's side. Such lower back or side pillows may be permanently or removably attached to one of the ends of the main pillow body. In this way, the main pillow may rest on a user's lap, with the lower back or side pillow being adjacent to the user's lower back or side. Further, the lower back or side pillows may be folded on top of the main pillow to adjust the height of the main pillow.

One feature of the side pillows is that the ends located away from the main pillow may be configured to taper down in height. This provides a number of advantages. For example, a baby may be placed on top of the main pillow and one of the side pillows, with the baby's head elevated above the feet. Such an arrangement is particularly useful when nursing the baby. Also, the height of the main pillow may be adjusted by folding over one or both of the side pillows. As one particular example, one of the side pillows may be folded on top of the main pillow while the other side pillow extends around the user's waist. In this way, the baby's head is elevated, with the rest of the baby's body angling downward. Such an orientation facilitates nursing by raising the height of the baby's head and keeping the stomach below the head, providing for better digestion and comfort. The tapering of the side pillows provides for such an orientation of the baby by providing an angled surface on top of the main pillow and an angled surface on the other (extending) side pillow. As another example, both side pillows may be folded onto the main pillow to further increase the height of the main pillow. By tapering both of the side pillows, the resulting surface is generally flat.

The tapering may be accomplished in a variety of ways, such as by providing one or more sew lines across the lower back pillow. Such lines may be straight, curved, or the like. Also, the number of lines may vary, such as from one to about three.

In some cases, the main pillow may include a gusset at the interior to permit the ends of the main pillow to be separated further from each other. Also, a belt or strap may also be provided to strap the pillow to the user's waist.

DETAILED DESCRIPTION OF THE INVENTION

In one aspect, the pillows of the invention comprise a pillow body that is gently curved. The amount of curvature is selected so that the ends of the pillow are spaced enough apart to permit the pillow to be placed around individuals having a variety of sizes. The amount of curvature may be defined in terms of an "average" radius of curvature. This dimension represents the radius that is generated if an arc is drawn between a center point of the pillow body and the two ends. Because the pillow may not be fashioned according to a true geometric arc, the term "average" is used to indicate it is merely an approximation. Hence, the pillow bodies may be curved according to a true arc or other type of geometric curvature. Further, the pillow bodies may have a wide variety of shapes and other design features including rounded or curved edges or ends, tapered sides or ends, patterned edges, sloping or curved sections and the like.

The pillows of the invention may also be used in combination with one or more padded attachments and/or auxiliary pillows (sometimes also referred to herein as lower back or side support pillows). These attachments and auxiliary pillows may be removably attached to the main pillow or provided with various adjustments to permit the location or position of the attachment members and/or pillows to be adjusted.

In some cases, the pillow bodies may include a center gusset to increase the distance that the ends may be separated from each other.

Figure 1:
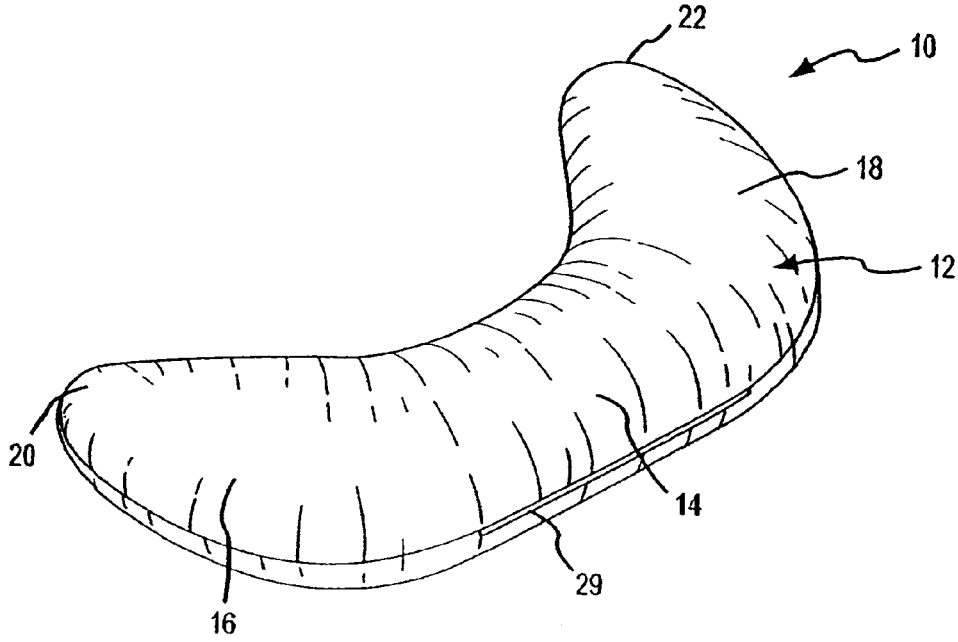
FIG. 1 is a front perspective view of an embodiment of a pillow according to the invention.
Figure 2:
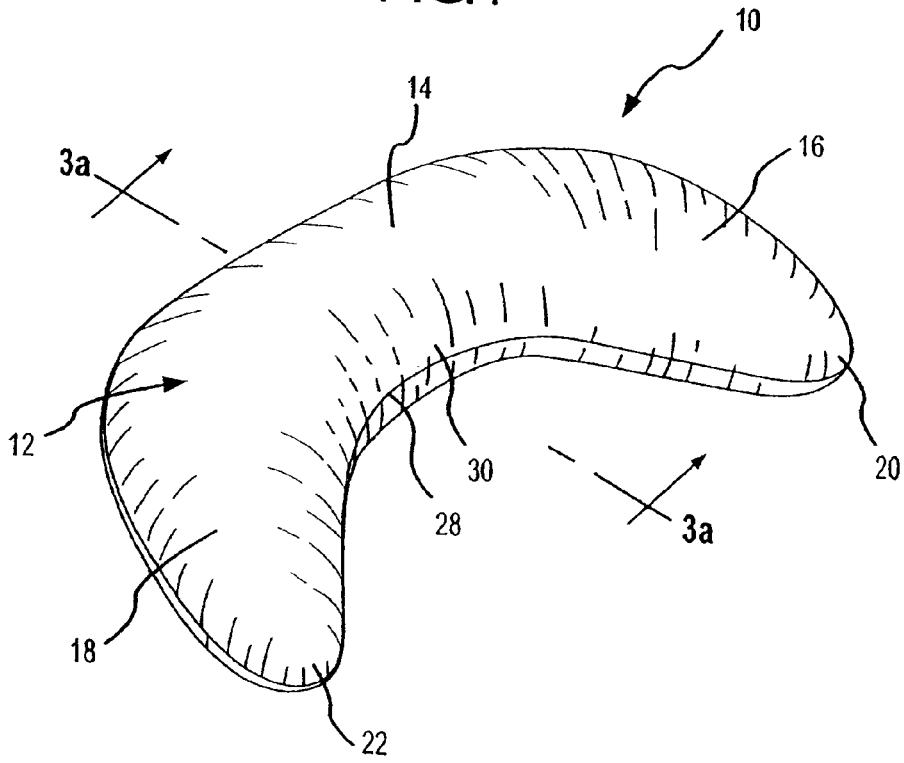
FIG. 2 is a rear perspective view of the pillow of FIG. 1.
Figure 3A:
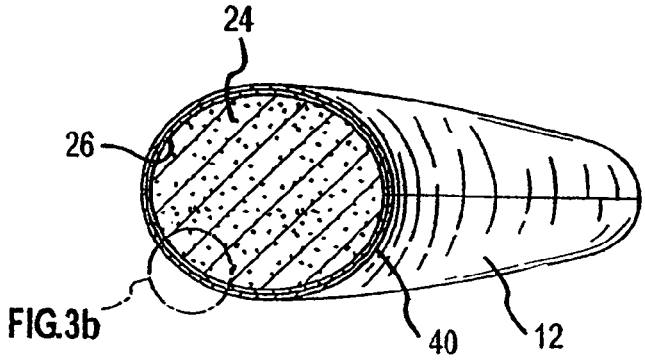
FIG. 3*a* is a cross sectional side view of the pillow of FIG. 1 with a removable slip cover.
Figure 3B:
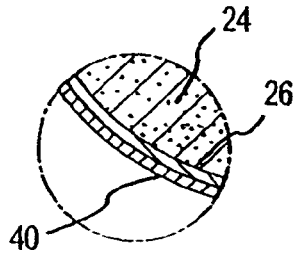
FIG. 3*b* is a more detailed view of the pillow of FIG. 3*a*.

Referring now to FIGS. 1 and 2, one embodiment of a pillow 10 will be described. Pillow 10 comprises a pillow body 12 having a midsection 14 and two end sections 16 and 18 that terminate in ends 20 and 22. As best shown in FIGS. 3*a* and 3*b*, pillow 10 may be constructed of a fill material 24 that is covered by a fabric cover 26. Examples of fill materials that may be used include resilient, compression resistant, hypoallergenic material, such as polyester fibers, and the like. Cover 26 may be any type of fabric such as cotton, nylon, LYCRA, denim, polyester and the like. Pillow body 12 may conveniently be constructed by sewing together two pieces of fabric along a center seam 28. The fill material 24 may be stuffed inside cover 26 to provide sufficient firmness so that pillow 10 generally does not sag or droop when held at midsection 14. This also provides sufficient firmness so that an item, object, baby or the like is supported without significant deflection or indentation of pillow body 12. Use of center seam 28 is also useful in that it helps the pillow body return to the shape shown in FIG. 1 if ends 20 and 22 are separated. For instance, if pillow 10 is placed around a larger individual, ends 20 and 22 may be pulled further apart. When released, seam 28 causes ends 20 and 22 to spring back to its original position. After stuffing the fill material within cover 26, the cover 26 may be closed by creating an exterior seam line 29. However, other techniques could be used as well. For example, a zipper could be used in place of an exterior seam.

It will be appreciated that various other techniques may be used to construct pillow 10. Merely by way of example, pillow 10 may be constructed using techniques similar to those described in U.S. Pat. Nos. 5,261,134; 5,661,861; 6,038,720; 6,055,687; 6,434,770; 6,352,612; 6,279,185; 6,412,128; 6,453,493; and 6,523,200; and in copending U.S. application Ser. No. 10/046,377, filed Oct. 26, 2001; Ser. No. 09,884,742, filed Jun. 18, 2001; Ser. No. 09/679,139, filed Oct. 3, 2000; Ser. No. 09/802,097, filed Mar. 8, 2001; Ser. No. 10/426,067, filed Apr. 28, 2003; and Ser. No. 10/612,267, filed Jul. 1, 2003. The complete disclosures of all these references are herein incorporated by reference.

Pillow 10 may have an average radius of curvature that permits it to conform to the shape of a person's torso while still having its ends separated enough so that it may fit around individuals of various sizes. The radius of curvature may be in the range from about 6 inches to about 16 inches, and more preferably from about 9 inches to about 11 inches. This may permit ends 20 and 22 to be separated by a distance in the range from about 14 inches to about 28 inches without stretching ends 20 and 22 apart. If pulled apart, the ends may separate several inches further. The distance from end 20 to end 22 through midsection 14 may be in the range from about 16 inches to about 36 inches, and more preferably from about 18 inches to about 28 inches. The distance from ends 20 and 22 to the inside of midsection 14 may be in the range from about 5 inches to about 11 inches, and more preferably from about 6 inches to about 7 inches. End sections 16 and 18 may have a length in the range from about 7 inches to about 15 inches, and more preferably from about 11 inches to about 13 inches. End sections 16 and 18 may also taper toward ends 20 and 22. The amount of taper may be in the range from about 10 inches to about 6 inches, and more preferably from about 8 inches to about 7 inches, near midsection 14 and taper to about 8 inches to about 3 inches, and more preferably from about 5 inches to about 4 inches, at ends 20 and 22. The height of midsection 14 may be in the range of about 9 inches to about 4 inches, and more preferably from about 7 inches to about 5 inches. This height may lessen along end sections 16 and 18 so that the height at ends 20 and 22 may be in the range from about 5 inches to about 1 inch, and more preferably about 3 inches. Midsection 14 may have a width in the range from about 14 inches to about 5 inches and more preferably from about 7 inches to about 10 inches, and a length in the range from about 12 inches to about 24 inches and more preferably from about 16 inches to about 20 inches.

Such dimensions permit pillow 10 to be used with children, teenagers and adults of various sizes. For example, when sitting down, inner side 30 would generally conform to the user's stomach and wrap around her sides. End sections 16 and 18 taper to permit them to fit between the arms of a chair and the user's side. Pillow 10 also has a height that permits a baby to sit on the pillow while breast feeding and to be positioned at an optimal height. A user's arms or elbows may also rest on pillow 10 to hold an item at about eye level. By having ends 20 and 22 wrap around the user's side, it facilitates supporting of the user's arms or elbows.

As shown in FIGS. 3*a* and 3*b*, a removable slip cover 40 may be placed over cover 26. Slip cover 40 may be constructed of a wide variety of fabrics, including any of those used for cover 26. Slip cover 40 may be configured to tightly conform to the shape of pillow 10 and may have one or more openings and one or more fasteners to permit pillow 10 to be inserted into cover 40 and then close cover 40. Cover 40 may also be used if pillow 10 is inflatable. Suitable types of slip covers are also described in U.S. Pat. No. 6,453,493 incorporated herein by reference.

Although not shown, it will be appreciated that other features may be added to pillow 10. For example, various toys or other items may be attached to or surrounded above pillow 10 as described in any of the references incorporated herein. Also a strap may extend between ends 20 and 22 to help hold pillow 10 about a user. As other examples, one or more pockets or other attachment members (such as straps) may be attached to pillow 10 to hold a variety of items, such as described in the references incorporated herein. As some specific examples, the pockets may be used to hold bottles, toys, burping cloths, and the like. Pillow 10 may also have one or more handles to help transport the pillow. Such handles may be similar to those described in references incorporated herein. Still further, pillow 10 may have a head member (such as an animal head) attached anywhere along the pillow, such as at one end. Examples of such head members are described in the references incorporated herein.

Pillow 10 may be packaged and stored using a variety of packing devices, purses or the like. Examples of such packages and bags are described in references incorporated herein and in copending U.S. application Ser. No. 09/884,742, filed Jun. 18, 2001, and Ser. No. 10/612,265, filed Jul. 1, 2003, incorporated herein by reference. Pillow 10 may also be displayed using any of the techniques or devices described in U.S. Pat. No. 6,119,873 incorporated herein by reference.

Figure 4:
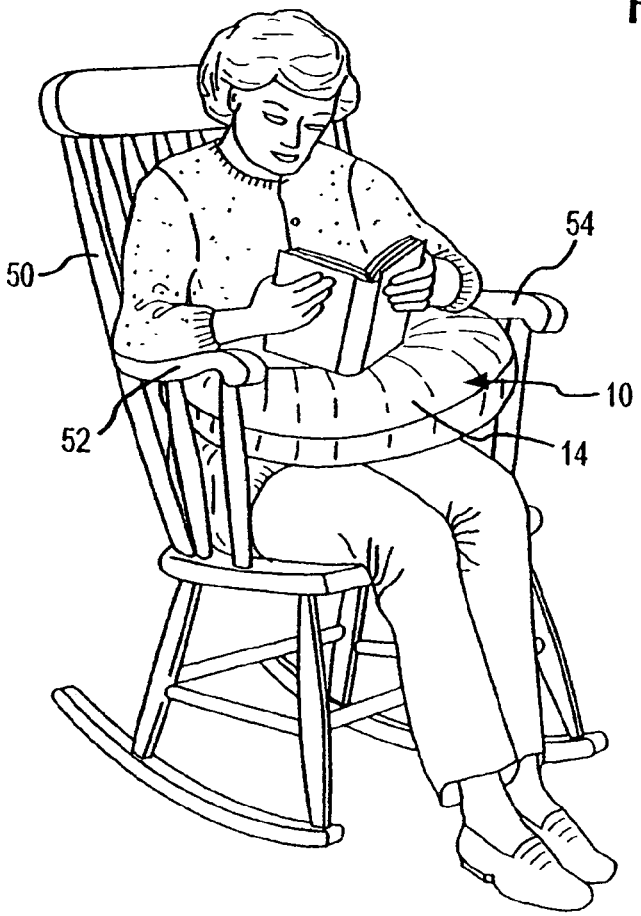
FIG. 4 illustrates the pillow of FIG. 1 when held in a user's lap according to the invention.

Referring now to FIG. 4, pillow 10 is shown resting on the lap of a user. The user is sitting in a chair 50 having a 'pair of arms 52 and 54. In this position, midsection 14 rests on the user's lap while end sections 16 and 18 wrap around the user's sides. Ends 20 and 22 fit between arms 52 and 54. In this way, a book or the user's elbows may rest on pillow 10. As another alternative, a baby may rest on pillow 10 while being fed or nursed. Examples of chairs having such arms include rocking chairs, wheel chairs, end chairs and the like. Other items that may be held include food, crafts, knitting, games, computers, phones and the like.

Further, it will be appreciated that a variety of other uses for pillow 10 exist. These may include, for example, as a back support, as a traditional pillow for the head, to prop up a baby or child, as a seat cushion or the like. As another example, the pillow may be used to support the legs or hips. For example, when a person is lying on his or her back, the pillow may be placed between the user's legs or knees and the ground. This permit's the person's legs to be propped up. As a further example, the pillow may be placed between the person's legs or knees while the person is lying on his or her side. As still another example, the pillow may be used as a back or front support when the person is lying on his or her side. For instance, for a pregnant woman, the pillow could be placed between the mother's stomach and the ground to help support the stomach. Other examples of how such a pillow may be used are described in any of the references incorporated herein.

A variety of attachment members may be coupled to any of the pillows described herein to modify or vary the height of the pillow. This may be done, for example, when there is a need to adjust the height of the top surface of the pillow relative to the user. For example, when the pillow is resting on a user's lap, such as when the pillow is being used to nurse an infant, the location of the top surface may be varied by attaching an attachment member to the pillow such that it rests between the pillow and the user's lap. In this way, if the baby's head needed to be lifted higher, this may be accomplished by providing the attachment member between the pillow and the mother's lap. The attachment member may be coupled to all of the pillow so as to adjust the height of the entire top surface of the pillow, or only be attached to a portion of the pillow so that only a portion of the top surface has its height adjusted. This arrangement may also configure the top surface of the pillow so that it is angled. In this way, the baby's head may be positioned higher than the rest of the baby's body. Also, a variety of coupling arrangements may be used to couple the attachment member to the pillow. For instance, the attachment member may have a coupling arrangement that is configured to wrap around the pillow and couple to itself. Alternatively, the coupling arrangement could be configured to engage a connector on the pillow to secure the attachment member to the pillow.

Figure 5:
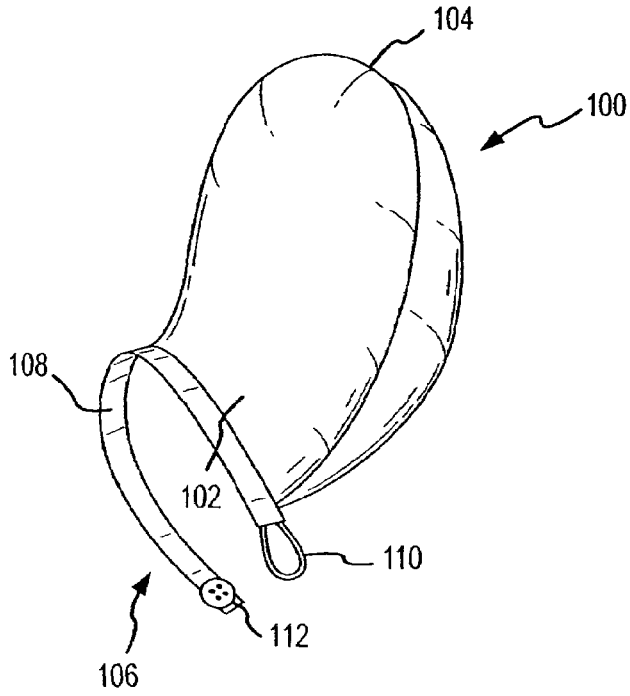
FIG. 5 is a perspective view of one embodiment of an attachment member for adjusting the vertical height of a pillow according to the invention.

FIG. 5 illustrates one embodiment of an attachment member 100. Attachment member 100 has an attachment end 102 and a curved end 104 that is intended to match the shape or curvature of one of the arms of the pillow. Attachment member 100 may be constructed of a fill material that is encased within a fabric cover or shell. Similarly, any of the techniques used to construct the pillow may also be used to construct attachment member 100. For example, attachment member 100 could alternatively be inflatable, or simply be a single piece of material, such as a polyurethane foam.

At attachment end 102 is a coupling arrangement 106 that comprises a belt 108 having a loop 110 at one end and a button 112 at the other end. In this way, attachment member 100 may be placed adjacent one of the arms of the pillow, with coupling arrangement 106 wrapped around the medial portion of the pillow. In this way, button 112 may be inserted through loop 110 to securely couple attachment member 100 to the pillow.

Figure 6:
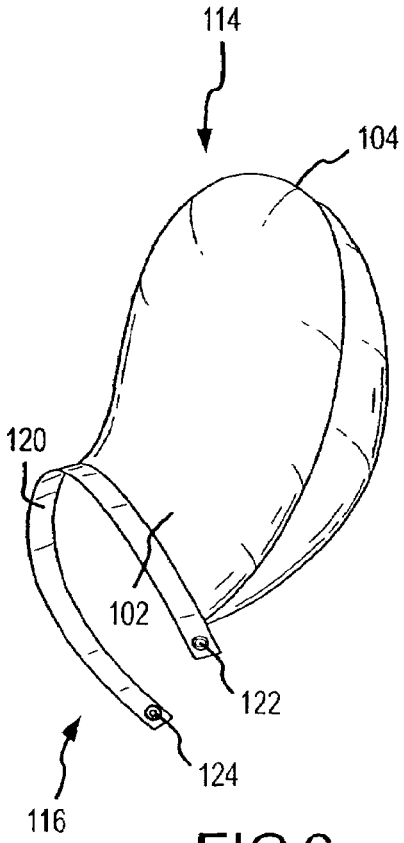
FIG. 6 is a perspective view of another embodiment of an attachment member according to the invention.

FIG. 6 illustrates another embodiment of an attachment member 114 that is similar to attachment member 100 except for the coupling arrangement. As such, the same reference numerals used to describe attachment member 100 will also be used to describe attachment member 114. Attachment member 114 includes a coupling arrangement 116 that comprises a belt 120 having a set of snaps 122 and 124. In this way, attachment member 114 may be attached to a pillow in a manner similar to attachment member 100, with snaps 122 and 124 engaging each other to secure belt 120 around the medial portion of the pillow.

Figure 7:
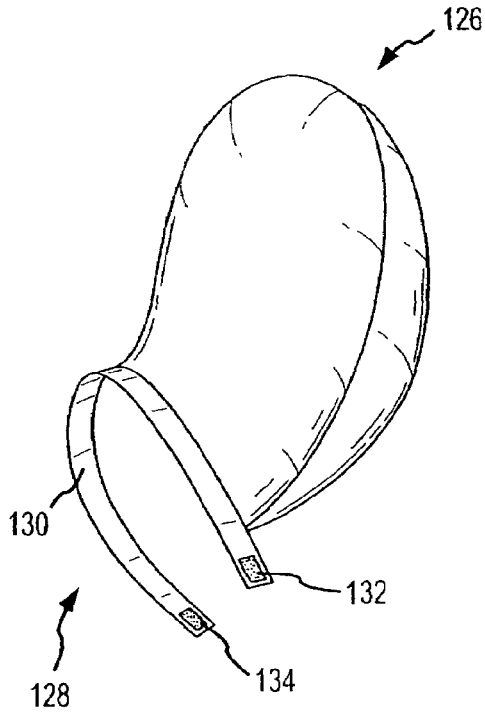
FIG. 7 is a perspective view of still another embodiment of an attachment member according to the invention.

FIG. 7 illustrates another embodiment of an attachment member 126 that is similar to attachment member 100 and will also use the same reference numerals. Attachment member 126 includes a coupling arrangement 128 having a belt 130 with two pieces of a hook and loop fastener material 132 and 134. With such a configuration, attachment member 126 may be coupled to a pillow similar to attachment member 100, with belt 130 being wrapped around the medial portion and the pieces of hook and loop fastener material 132 and 134 being secured to each other.

Figure 8:
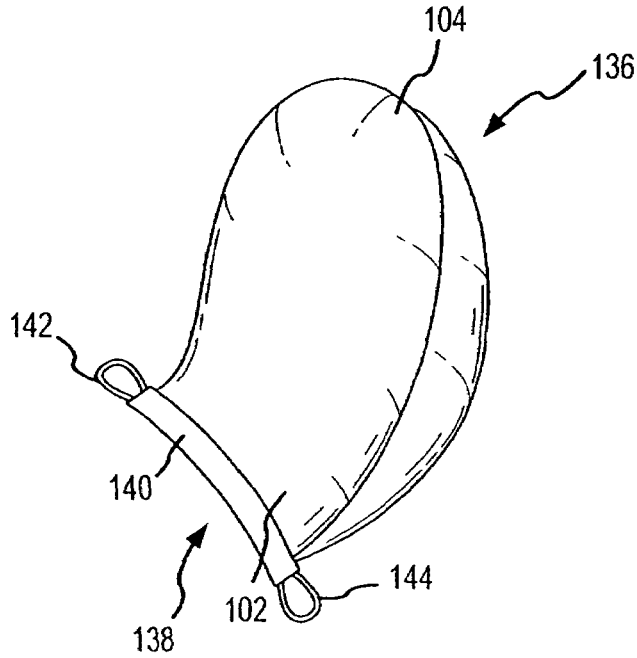
FIG. 8 is a perspective view of yet another embodiment of an attachment member according to the invention.
Figure 9:
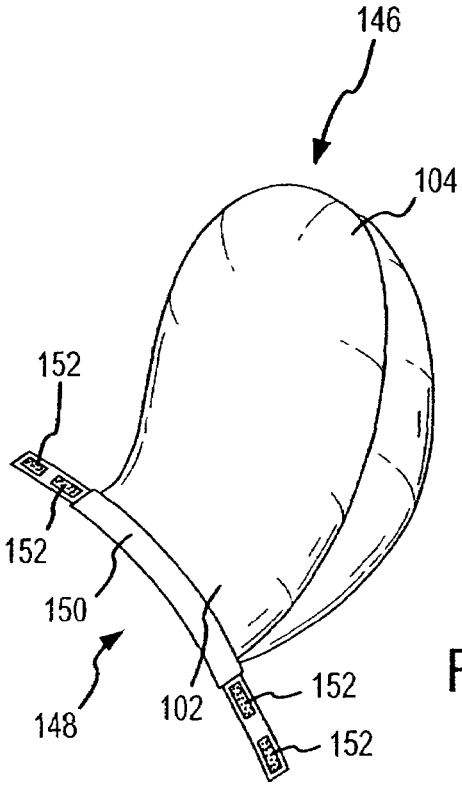
FIG. 9 is a perspective view of still yet another embodiment of an attachment member according to the invention.
Figure 10:
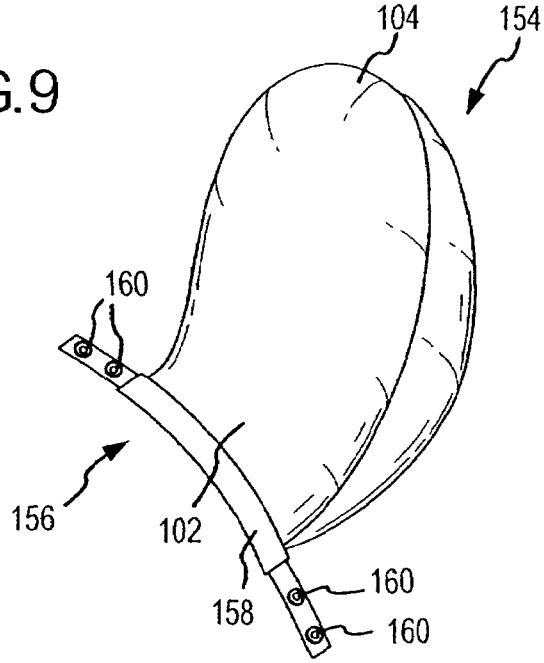
FIG. 10 is a perspective view of one particular embodiment of an attachment member according to the invention.

FIGS. 8-10 illustrate other embodiment of attachment members that are also similar to the attachment members illustrated in FIGS. 5 and 7, except for the coupling arrangements used to couple the attachment members to the pillow. As such, the same reference numerals used in connection with attachment member 100 will also be used in describing the attachment members of FIGS. 8-10. In FIG. 8, an attachment member 136 has a coupling arrangement 138 that comprises a connector 140 having a pair of loops 142 and 144. These loops 142 and 144 are configured to interlock with buttons that are coupled to the support pillow. In this way, attachment member 136 may be placed adjacent one of the arms of the pillow and loops 142 and 144 looped around buttons on the medial region of the pillow.

FIG. 9 illustrates an attachment member 146 having a coupling arrangement 148 that comprises a connector 150 having strips of a hook and loop fastener material 152. Attachment member 146 is configured to be coupled to a pillow in a manner similar to attachment member 136, with the strips 152 interlocking with corresponding strips of a hook and loop fastener material that are directly formed on the pillow.

FIG. 10 illustrates an attachment member 154 having a coupling arrangement 156 that comprises a connector 158 having a set of snaps 160. Hence, attachment member 154 may be coupled to pillow in a manner similar to attachment member 136, with snaps 160 engaging with corresponding snaps that are formed directly on the pillow.

Figure 11:
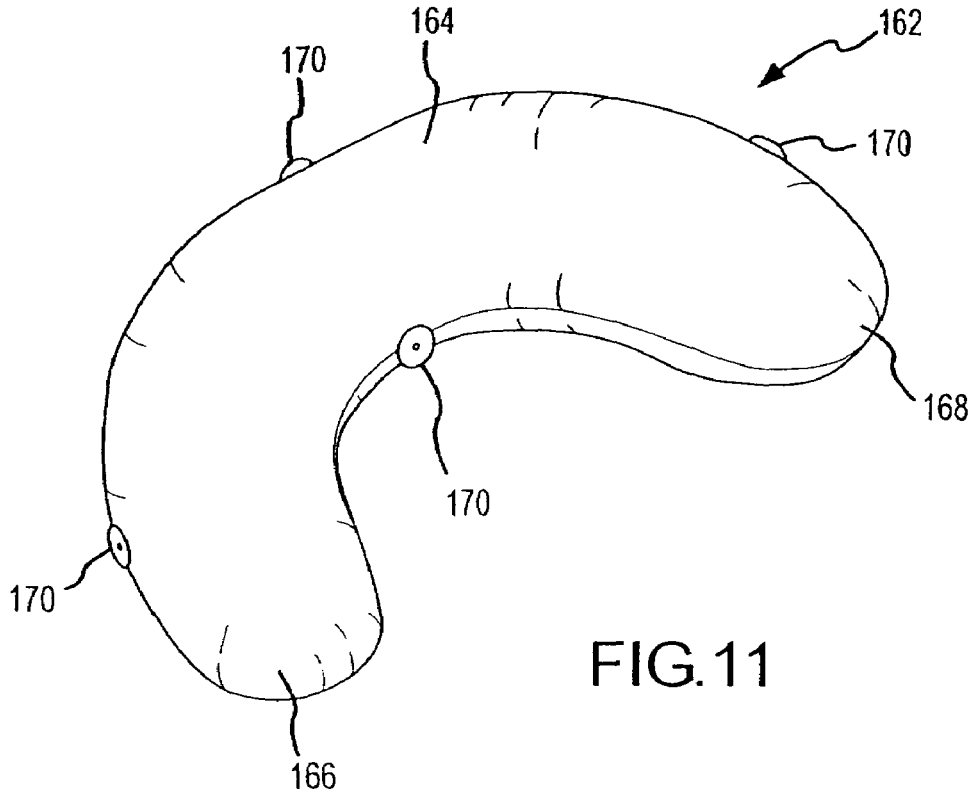
FIG. 11 is a perspective view of one embodiment of a pillow that includes a plurality of connectors that may be used to attach an attachment member to the pillow according to the invention.

FIG. 11 illustrates one embodiment of a support pillow 162 having a medial region 164 and ends 166 and 168. Support pillow 162 may be constructed to be similar to any of the support pillows described herein and will not be described in further detail. Sewn or otherwise attached to pillow 162 are a set of buttons 170 that may be used to couple an attachment member to pillow 162. For example, the attachment member 136 of FIG. 8 may be coupled to pillow 162 by simply looping loops 142 and 144 around buttons 170 that are disposed at medial region 164, and with end 104 aligning generally with end 168. Further, it will be appreciated that only one of the buttons 170 may be used to attach an attachment member to the pillow, or more than one of the buttons 170 may be used.

Figure 12:
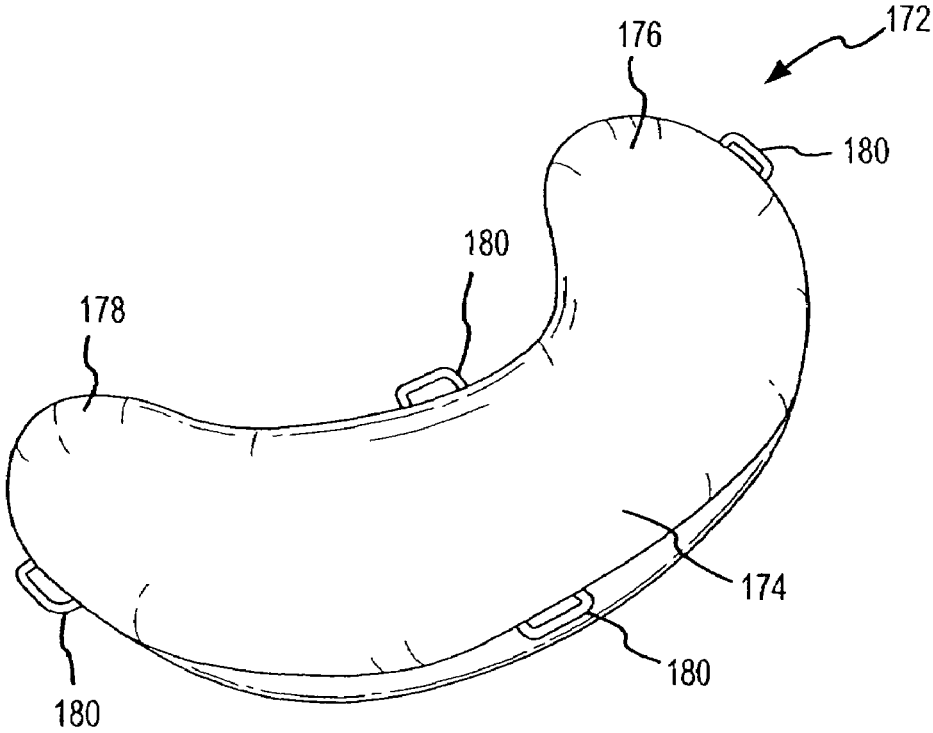
FIG. 12 is a perspective view of another embodiment of a pillow having another set of connectors according to the invention.

FIG. 12 illustrates another embodiment of a support pillow 172 that may also be constructed to be similar to any of the support pillows described herein. Support pillow 172 comprises a medial region 174 and two ends 176 and 178. Disposed along the outer periphery of pillow 172 are fabric loops 180. Loops 180 may be used to couple an attachment member to the pillow 172. For instance, attachment members 100, 114 and 126 may be coupled to pillow 172 by wrapping belts 108, 120 and 130 around medial region 174 while passing through loops 180 before the connectors are engaged. As alternative, pillow 172 could be used with attachment members 146 and 154. For instance, with attachment member 146, connector 150 could be placed around loops 180 at medial region 174, with each end of connector 152 wrapping around the loop 180 and having the two pieces of hook and loop fastener material at each end interlock with each other. In this way, each end of connector 150 will be wrapped around its own loop 180 and coupled to itself using the piece of hook and loop fabric 152. Only one of the loops 180 may be used to couple an attachment member to the pillow, or multiple loops may be used.

Figure 13:
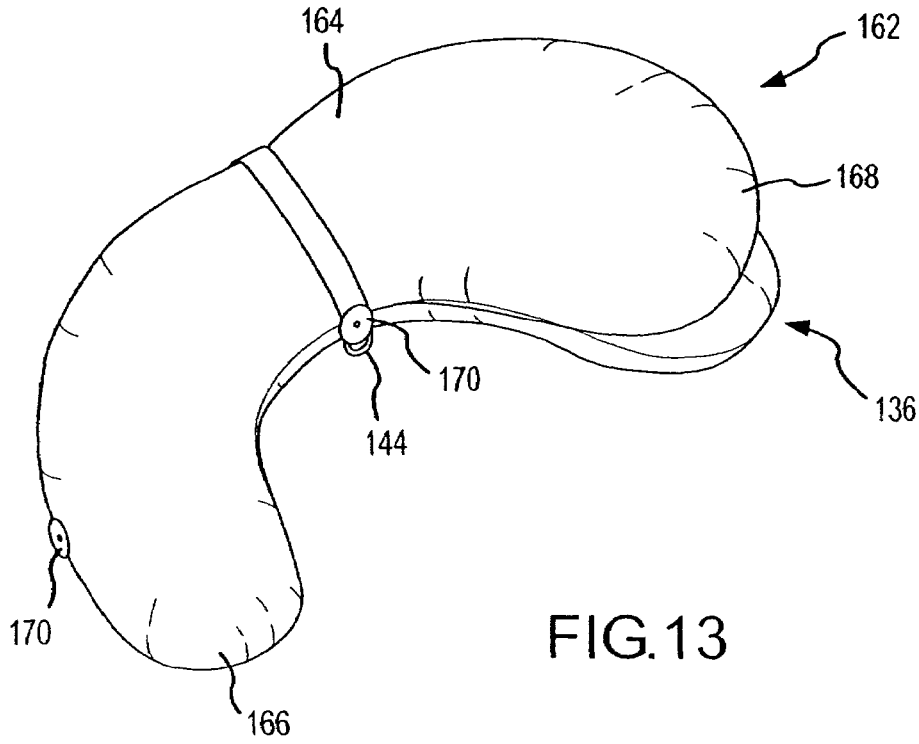
FIG. 13 is a top perspective view of one embodiment of a pillow having an attachment member coupled thereto according to the invention.
Figure 14:
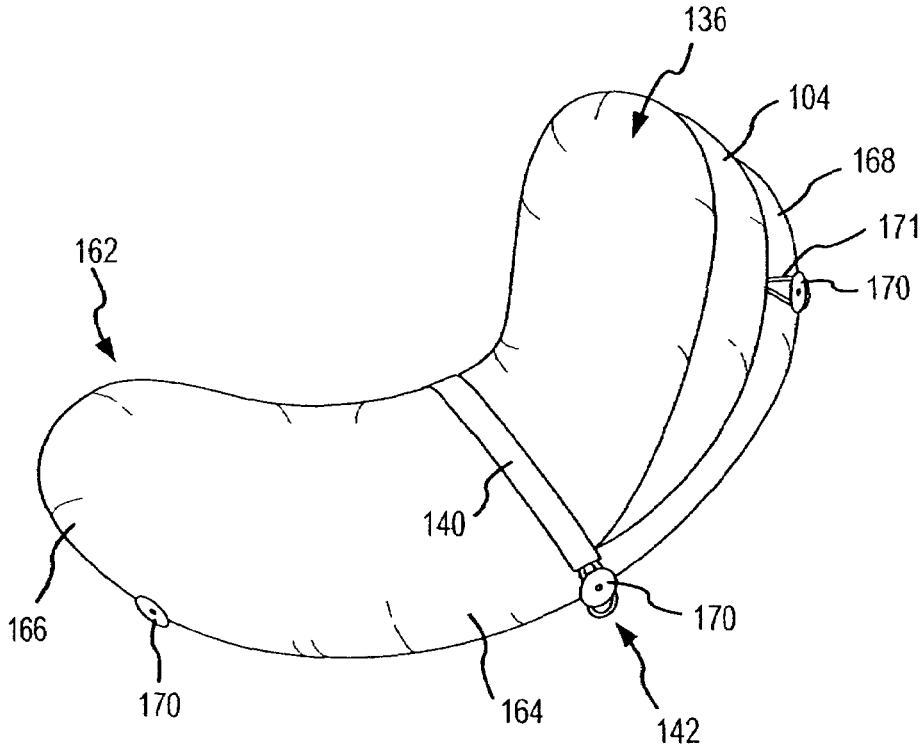
FIG. 14 is a bottom perspective view of the pillow and attachment member of FIG. 13.

FIGS. 13 and 14 illustrate pillow 162 coupled to attachment member 136 of FIG. 8. As shown, loops 142 and 144 are looped around buttons 170 at medial region 164. As an alternative, only one of the buttons 170 may be used, up to all of the buttons 170. For instance, as shown in FIG. 14, attachment 136 may include an optional loop 171 near end 104 that will be connected to another button 170 on pillow 162. In some cases, this button may be the only needed to couple the attachment member to the pillow. As previously described, attachment member 100 may be attached in a similar manner, but in such cases buttons 170 may not be included directly on pillow 162. Instead, connector 108 may be wrapped around medial region 164, with button 112 being inserted through loop 110.

Figure 15:
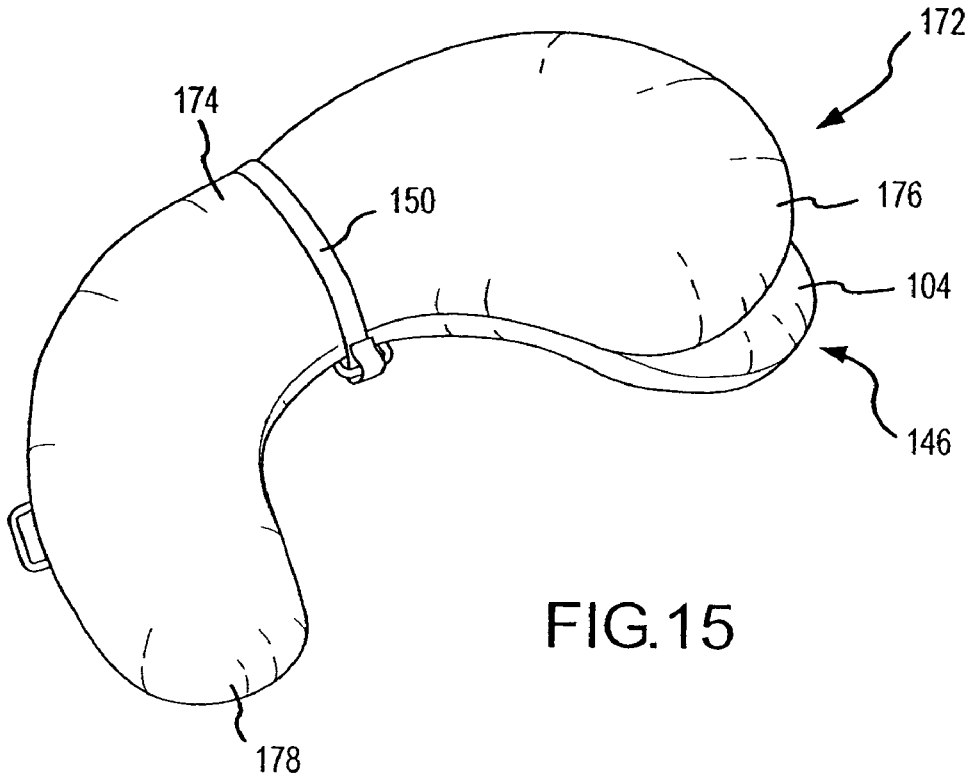
FIG. 15 is a top perspective view of another embodiment of a pillow having an attachment member coupled thereto.
Figure 16:
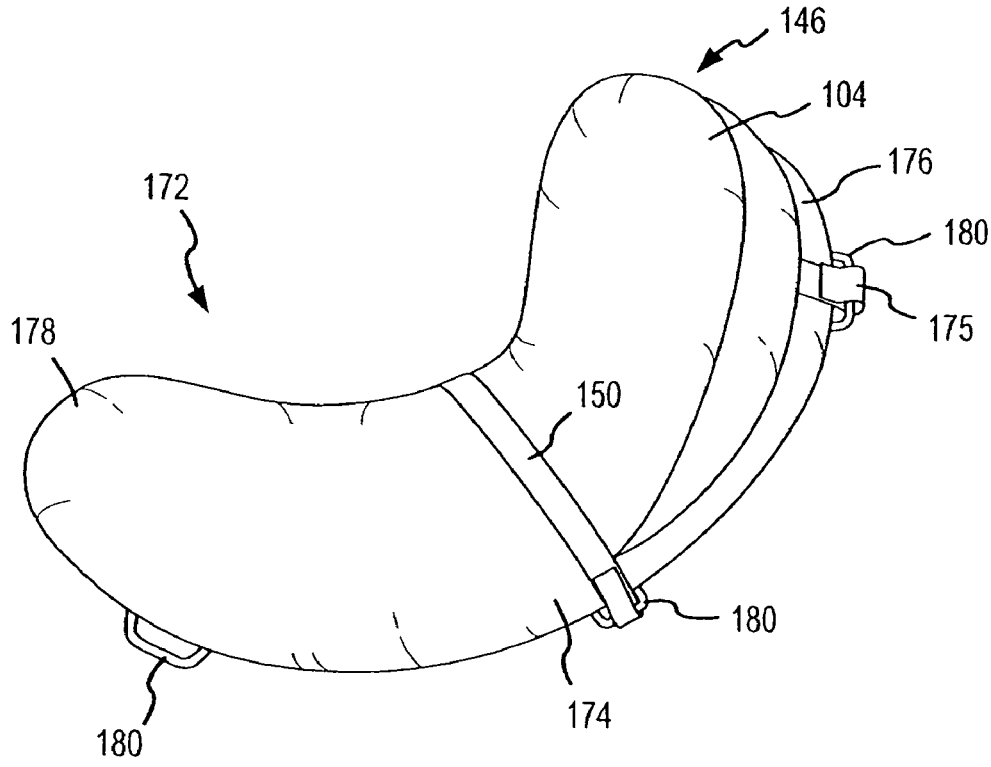
FIG. 16 is a bottom perspective view of the pillow and attachment member of FIG. 15.

FIGS. 15 and 16 illustrate sport pillow 172 that is coupled to attachment member 146 of FIG. 9. As shown, end 104 is configured to generally match with end 176, while connector 150 is placed about medial region 174. Each end of connector 150 is wrapped about one of the loops 180 at medial region 174 and folded back on itself so that the two pieces of hook and loop fastener material engage. Optionally, attachment member 146 may include another connector 175 with pieces of hook and loop fastener material that wrap around loop 180 near end 176 as shown in FIG. 16. This may be the only attachment point needed. As with other embodiments, a single connector may be wrapped around one of the loops, or multiple loops and connectors may be used. Also, it will be appreciated that in an alternative embodiment, attachment member 126 of FIG. 7 may be connected in a similar manner, with connector 130 wrapped entirely about medial region 174 and pieces 132 and 134 interlocked with each other.

Figure 17:
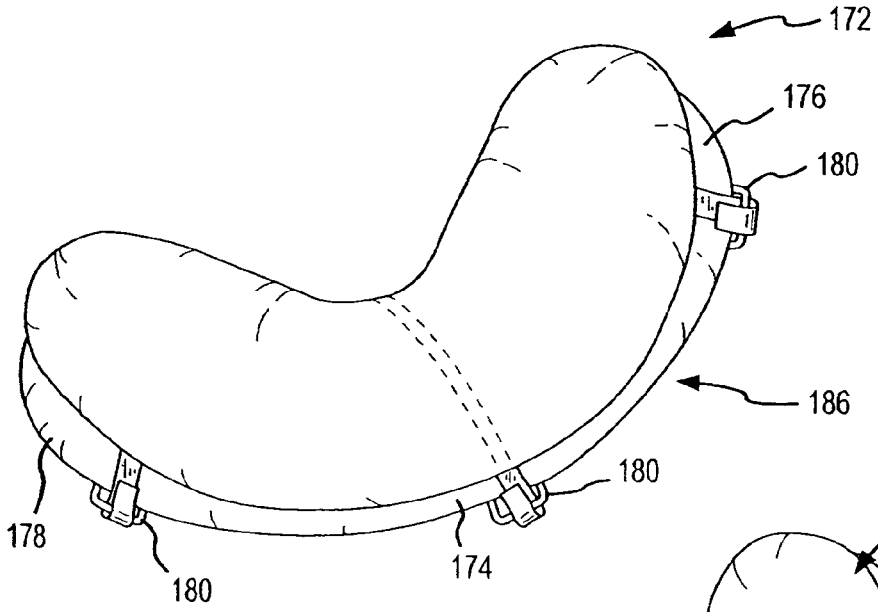
FIG. 17 is a top perspective view of a pillow having an alternative attachment member coupled thereto.
Figure 18:
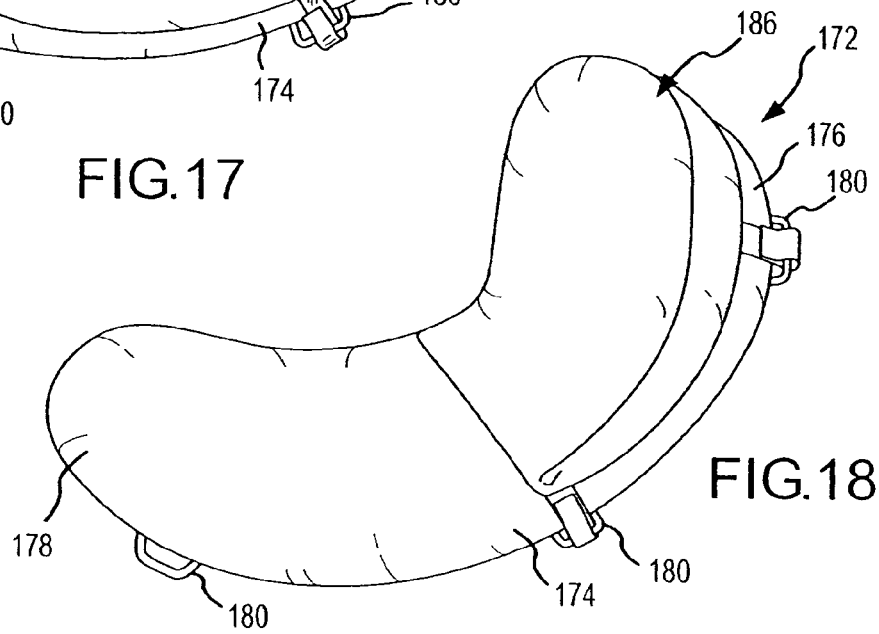
FIG. 18 is a bottom perspective view of the pillow and attachment member of FIG. 17, with the attachment member folded in half according to the invention.
Figure 19:
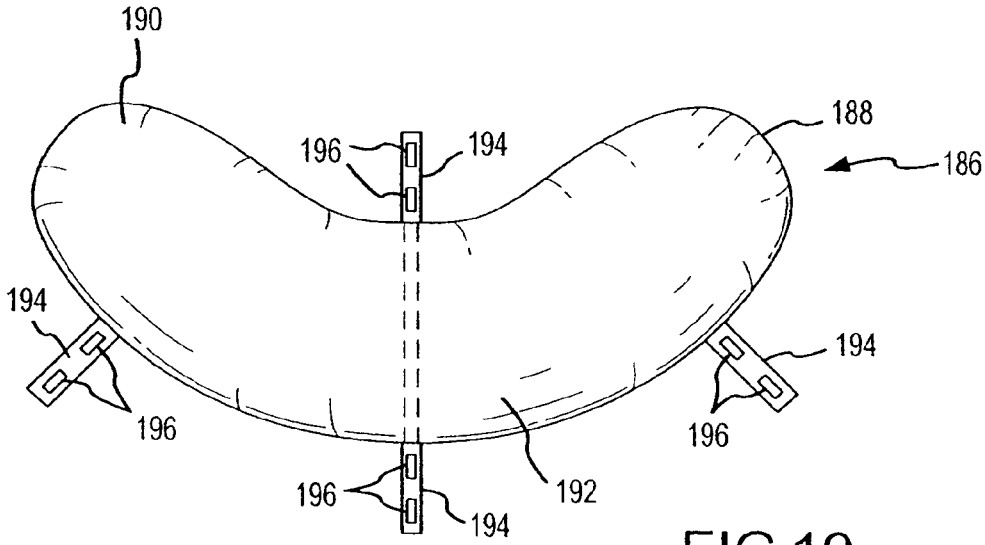
FIG. 19 illustrates the attachment member of FIG. 17 when removed from the pillow.

FIGS. 17 and 18 illustrate support pillow 172 that is coupled to an alternative attachment member 186. As best illustrated in FIG. 19, attachment member 186 has two curved ends 188 and 190 and a medial region 192. Attachment member 186 is curved and generally has the same outer periphery as support pillow 172 (or any of the support pillows described herein). Attachment member 186 may be constructed of a generally resilient fill material that is encased in a shell or fabric covering similar to the other attachment members or support pillows described herein. Alternatively, attachment member 186 may be constructed of a single piece of material, such as a foam material, inflatable bladder, or the like. Attachment member 186 includes a set of connectors 194 that each include two pieces of a hook and loop fastener material 196. As an alternative to a hook and loop fastener material, it will be appreciated that other connectors could be used, such as snaps, loops, buttons, buckles, and the like. Referring back now to FIG. 17, attachment member 186 may be coupled to support pillow 172 by wrapping connectors 194 around loops 180 and then folding the connectors over themselves until the two pieces of hook and loop fastener material 196 engage with each other. In this way, the entire vertical height of support pillow 172 may be adjusted. Alternatively, the height of one end of attachment member 186 could be made higher than the other end so that the vertical height of the top surface of support pillow 172 may be angled.

As an alternative, attachment member 186 may be folded over itself at medial region 192 as illustrated in FIG. 18. In this way, the vertical height of half of support pillow 172, i.e., at end 176, may be made twice as high. In this way, the top surface of the support pillow 172 will be angled downward when worn on a user's lap.

Figure 20:
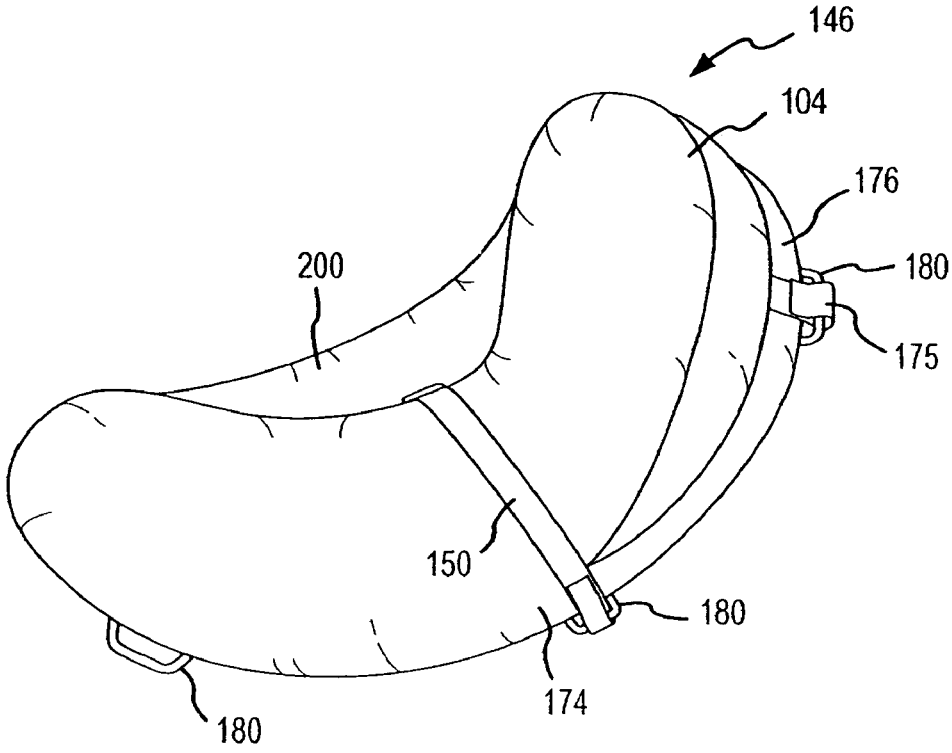
FIG. 20 illustrates the pillow and attachment member of FIG. 18 with a support member according to invention.
Figure 21:
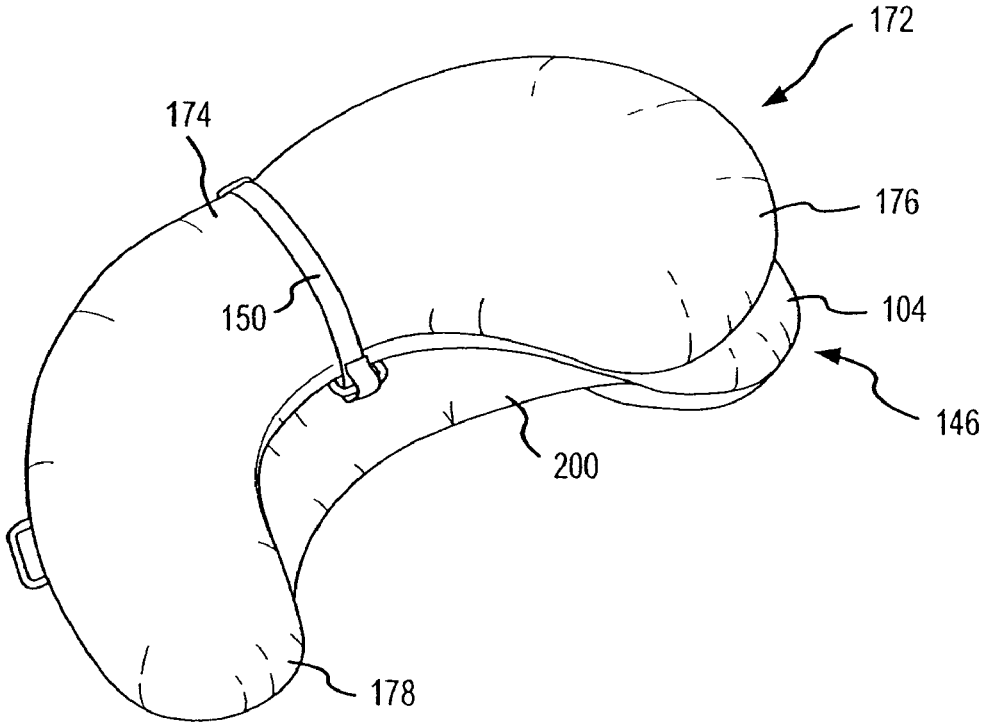
FIG. 21 is a top perspective view of the pillow and attachment member of FIG. 20.

FIG. 20 illustrates support pillow 172 and attachment member 146 along with a support member 200. Support member 200 may be a strip of fabric that is sewn to medial region 174 of pillow 172 at the inner periphery and serves to help support an object that rests on the top surface of pillow 172. Support member 200 may be constructed in a manner similar to the support members described in U.S. Pat. No. 6,763,539, the complete disclosure which is herein incorporated by reference. In some cases, support member 200 could even be attached to attachment member 146 so that attachment member 146 may be used to modify an existing pillow that does not include such a support member.

As a further option, it will be appreciated that a support member similar to support member 200 may be utilized with any of the support pillows described herein. The support member 200 may extend from each of the ends so that it extends across the well region formed along the inner periphery of the pillow.

Figure 22:
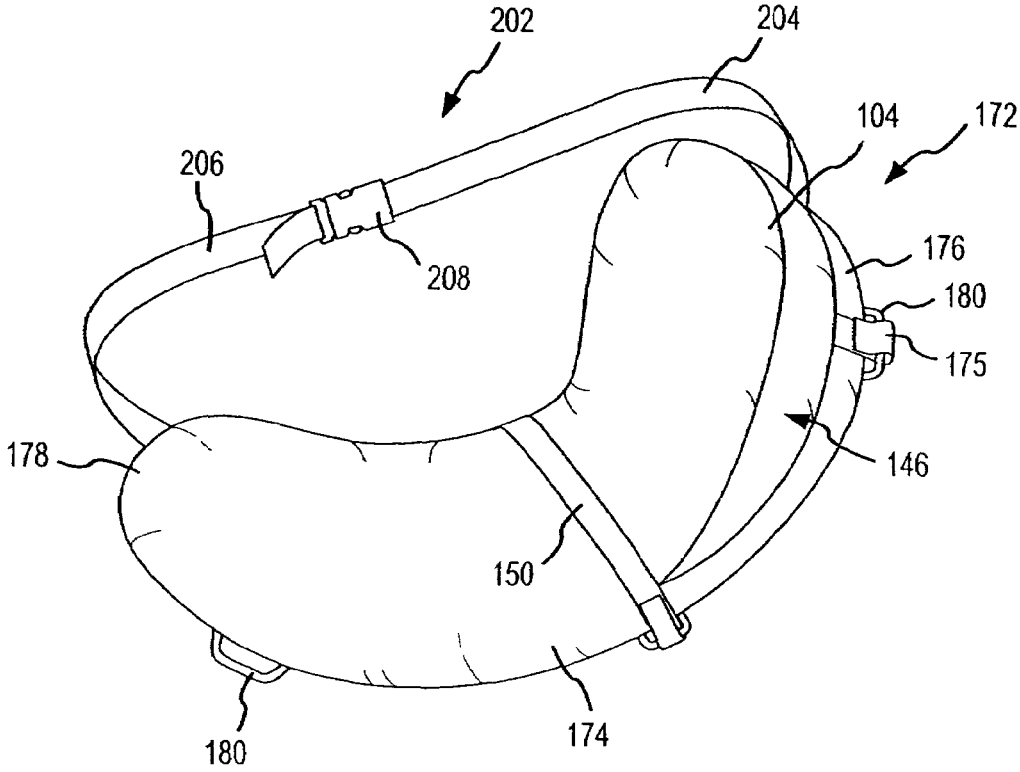
FIG. 22 is a bottom perspective view of the pillow and attachment member of FIG. 18 with an adjustable belt according to the invention.

FIG. 22 illustrates support pillow 172 and attachment member 146 with the addition of an adjustable belt 202. Belt 202 comprises two straps 204 and 206 that are coupled to ends 176 and 178. A connector 208 such as an interconnecting buckle may be used to couple the two straps 204 and 206 together. In use, pillow 172 is placed on a user's lap, with straps 206 and 204 extending around the user's back. Buckle 208 may then be used to secure belt 202 around the user to prevent pillow 172 from shifting around during use.

Although described in connection with pillow 172, it will be appreciated that belt 202 may be used with any of the pillows described herein, and in connection with any of the attachment members described herein.

Figure 23:
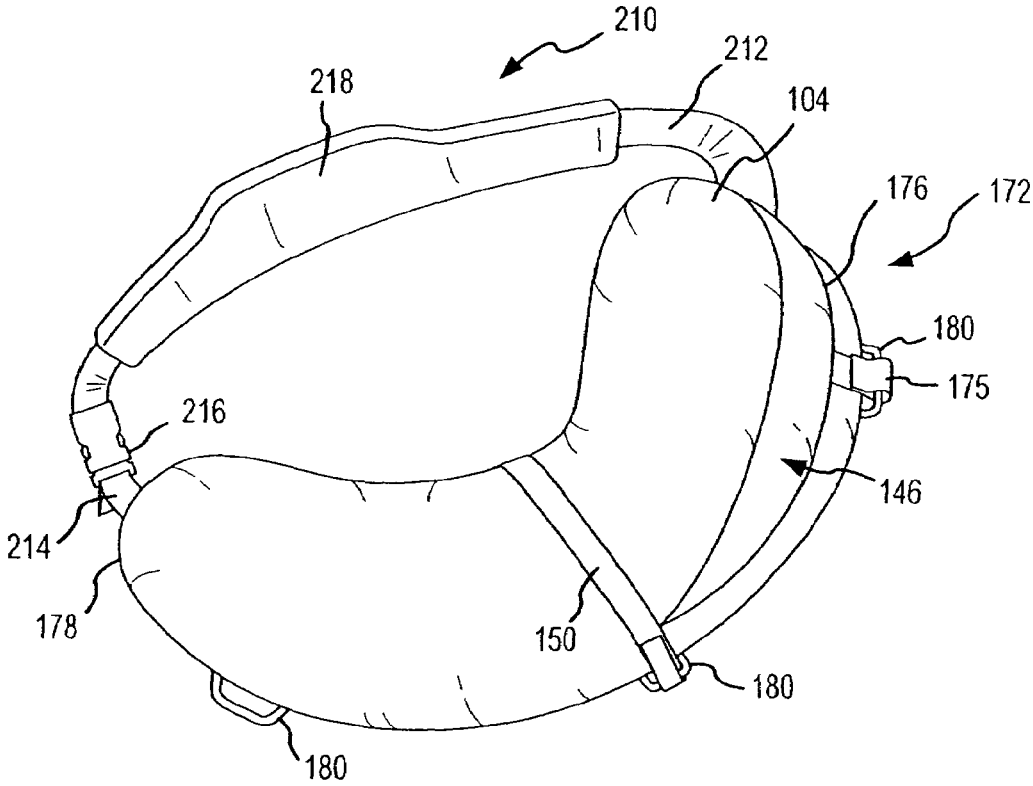
FIG. 23 illustrates the pillow and attachment member of FIG. 18 with an alternative belt according to the invention.

FIG. 23 illustrates pillow 172 and attachment member 146 with an alternative belt 210 that is attached to ends 176 and 178. Belt 210 comprises two straps 212 and 214 that are connected with a connector 216, such as a buckle. Also, strap 212 includes a padded section 218 that is placed against the user's back to provide comfort and support when belt 218 is placed around the user's back. Also, it will be appreciated that belt 210 may be used in connection with any of the pillows or attachment members described herein.

Figure 24:
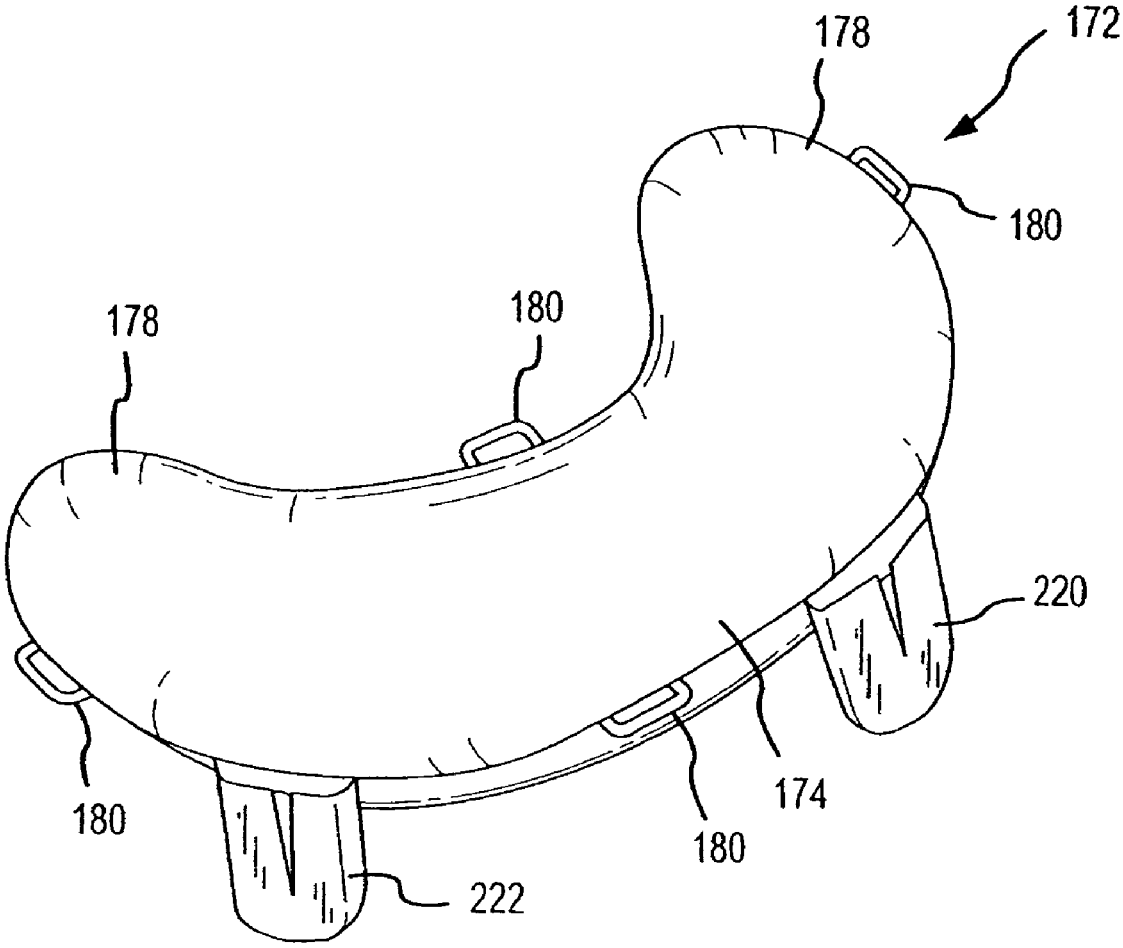
FIG. 24 is a top perspective view of the pillow of FIG. 12 with an arrangement of pockets according to the invention.

FIG. 24 illustrates support pillow 172 that includes a pair of pockets 220 and 222. These pockets are placed on the outer perimeter of the support pillow and may be used to hold a variety of peripheral items, such as bottles, pacifiers, bottles, toys, nursing supplies, ointments, diapers, and the like. Further, it will be appreciated that pockets 220 and 222 may be provided at other locations on the pillow and may have different sizes. Also, different numbers of pockets may be utilized. In some cases, similar pockets could also be provided on any of the attachment members described herein. In a similar manner, pockets 220 and 222 could be included on any of the support pillows described herein.

Figure 25:
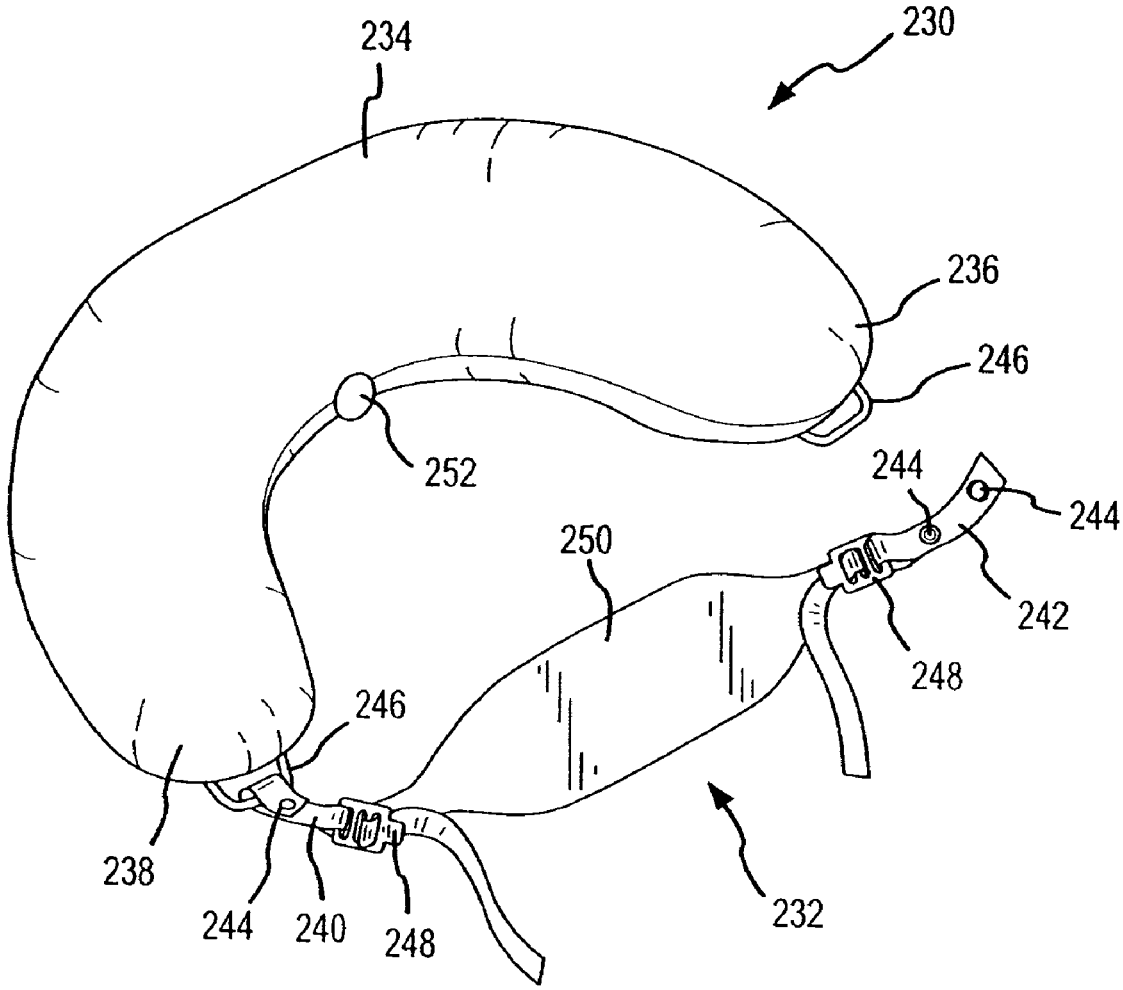
FIG. 25 illustrates one particular embodiment of a pillow with another embodiment of an adjustable belt according to the invention.

FIG. 25 illustrates support pillow 230 with the addition of an adjustable belt 232. Support pillow 230 comprises a medial region 234 and two ends 236 and 238 similar to other embodiments described herein. Belt 232 comprises two straps 240 and 242 that are coupled to ends 238 and 236. A connector 244, such as a pair of snaps is provided on each strap 240 and 242 and may be looped around loops 246 at each end 236 and 238 of pillow 230 and snapped together. Other connectors include any of those described herein. Also, straps 240 and 242 also include a length adjuster 248 having multiple slits that may be used to connect straps 240 and 242 as well as to adjust their length. Belt 232 may also include a padded support region 250 that also includes strap ends that are connected adjusted 248 to permit the length of these ends to be adjusted as well. In use, pillow 234 is placed on a user's lap, with straps 240 and 242 extending around the user's back. Adjuster 248 may then be used to secure belt 232 around the user to prevent pillow 234 from shifting around during use. Also, pillow 234 may include a button 252 or other connectors to attaching to an attachment member similar to other embodiments.

Although described in connection with pillow 234, it will be appreciated that belt 232 may be used with any of the pillows described herein, and in connection with any of the attachment members described herein.

In use, any of the attachment members that are attached to one of the pillows may be placed directly against the user's lap. Alternatively, the attachment members may be placed on the top surface of the pillow which rests on the user's lap so that the object, such as a baby, that is lying on the pillow will directly engage the attachment member.

Any of the pillows described herein may also be used with one or more lower back or side pillows. Such lower back or side pillows may be permanently or removably attached to the main pillow. In this way, when the main pillow rests on the user's lap, the arms of the main pillow will be adjacent the user's sides, and the lower back pillow will be placed against the user's lower back. If sitting in a chair, the lower back pillow will rest between the back of the chair and the user's back to provide support to the lower back. The manner in which the lower back pillow is attached to the main pillow may be adjustable so that the lower back pillow will contact the appropriate position on the lower back while the main pillow is on the user's lap and snug about a the user's stomach and sides. Also, the size and shape of the lower back pillow may be varied according to the size and shape of the user as well as for any back ailments. For example, the lower back pillow could be rectangular, oval, round, kidney bean shaped or the like. Also, the lower back pillow may be constructed using any of the materials and/or techniques used to construct the main pillow.

Figure 26:
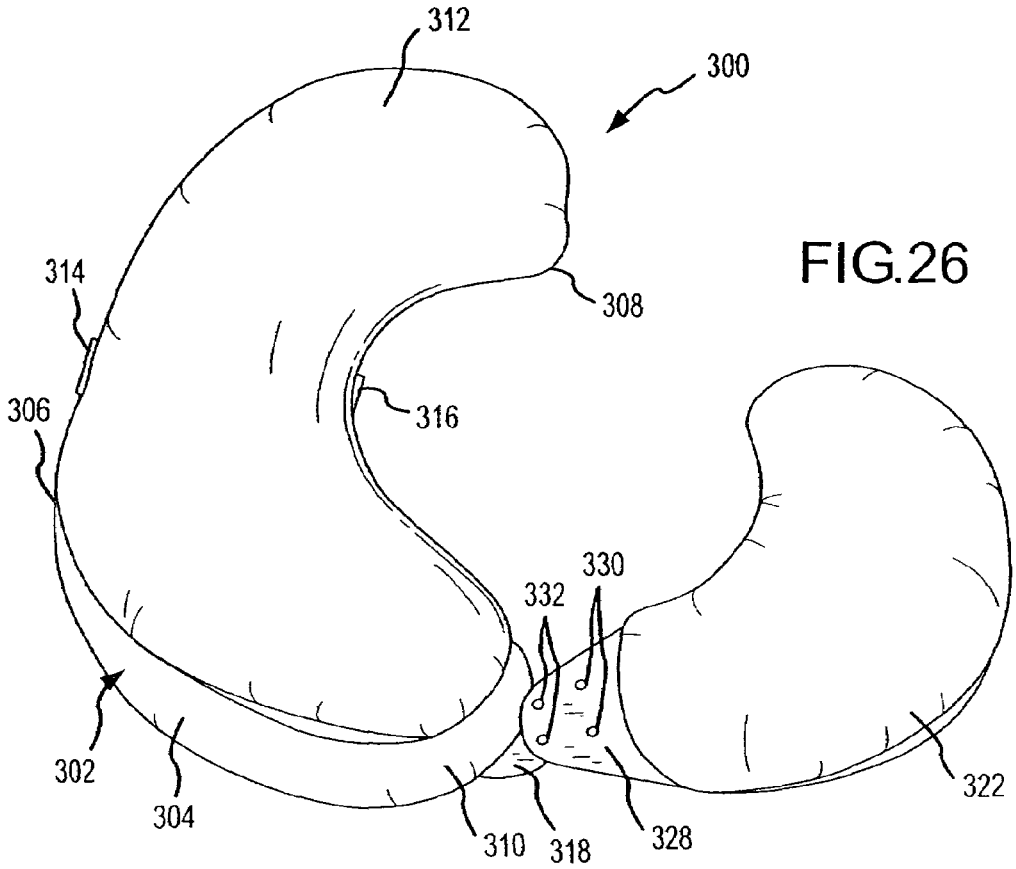
FIG. 26 illustrates an embodiment of a pillow system having a main pillow, a lower back pillow and an attachment member according to the invention.
Figure 27:
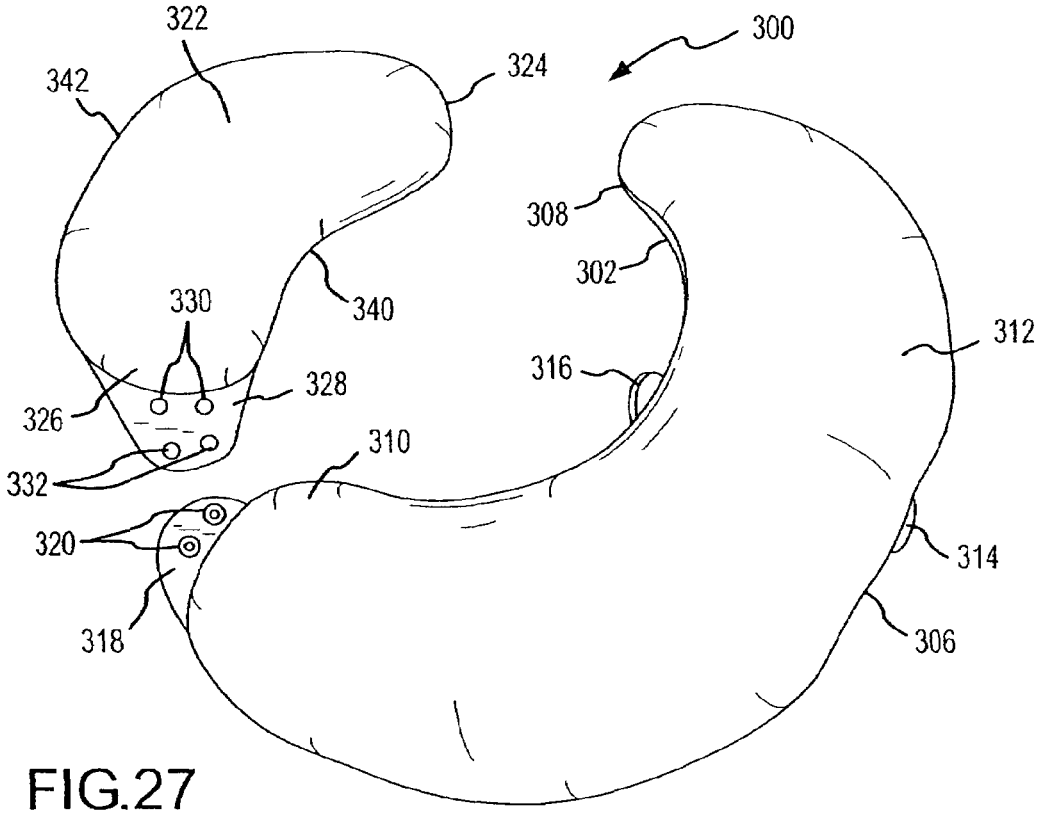
FIG. 27 illustrates the main pillow and lower back pillow of FIG. 26 when separated from each other.

Referring now to FIGS. 26 and 27, one embodiment of a pillow system 300 will be described. System 300 comprises a main pillow 302 that comprises a pillow body 304 having a medial region 306 and two end 308 and 310. Main pillow 300 may be constructed using the same dimensions and/or materials as any of the pillows described herein. Optionally, a removable padded attachment member 312 may be attached to a main pillow 302. Padded attachment member 312 may be constructed in a manner similar to any of the padded attachment members described herein and may be removably attached to the main pillow using any of the attachment schemes described herein. As shown, main pillow 302 includes buttons 314 and 316 over which loops (not shown) on attachment member 312 engage.

End 310 includes a fabric extension 318 that includes a pair of snaps 320 that permit main pillow 302 to be removably coupled to a lower back pillow 322. More specifically, lower back pillow includes a pair of ends 324 and 326, one of which includes a fabric extension 328 having two sets of snaps 330 and 332. In this way, lower back pillow 332 may be removably attached to main pillow 302 by snapping snaps 330 or 332 into snaps 320 of main pillow 302. The use of two pairs of snaps permits the distance between lower back pillow 322 and main pillow 302 to be adjusted. In this way, the position of lower back pillow 322 relative to the user's lower back may be adjusted so that main pillow 302 may be positioned against the user's stomach and sides described herein. This is particularly useful in that it allows one size of main pillow and lower back pillow to be used with a variety of users of different sizes.

Although described with snaps, it will be appreciated that a wide variety of other attachment schemes may be used, such as buttons, a hook and loop fastener material, ties and the like. Further, although shown attached to end 310, it will be appreciated that lower back pillow 322 could be attached to end 308 or to both ends 308 and 310. Also, other attachment schemes could be used other than by using fabric extensions, such as by use of ties.

Lower back pillow 322 is kidney bean shaped in geometry. This configuration permits the inner periphery 340 of pillow 322 to be placed about the user's lower back, generally conforming to the shape of the back. The outer periphery can rest against a support surface, such as the back of a chair, a wall or the like. In one particular embodiment, lower back pillow 322 may have a length from end 324 to end 326 that is in the range from about 10 inches to about 30 inches. Flap 328 may have a length in the range from about 1 inch to about 6 inches, and snaps 330 may be spaced from snaps 332 by a distance in the range from about 1 inch to about 4 inches. Lower back pillow 332 may have a vertical height in the range from about 2 inches to about 6 inches and a width (from inner periphery 340 to outer periphery 342) in the range from about 6 inches to about 12 inches.

Lower back pillow 322 may be constructed of a fabric shell that encases a fill material similar to the other pillows described herein. Optionally, a removable cover could also be placed about the pillow and may include attachments for attaching lower back pillow 322 to main pillow 302.

In use, main pillow 302 may be placed on a user's lap while sitting, with ends 308 and 310 extending around the user's sides. If desired, padded attachment member 312 may be used to increase the height and/or vary the angle of the top surface similar to other embodiments. Lower back pillow 322 is also placed against the user's lower back. One particular application is when nursing a baby. In this way, the main pillow and optionally the padded attachment may be used to support the baby while the mother is sitting. At the same time, lower back pillow 322 supports the mother's lower back. If desired, lower back pillow 322 can simply be removed.

Figure 28:
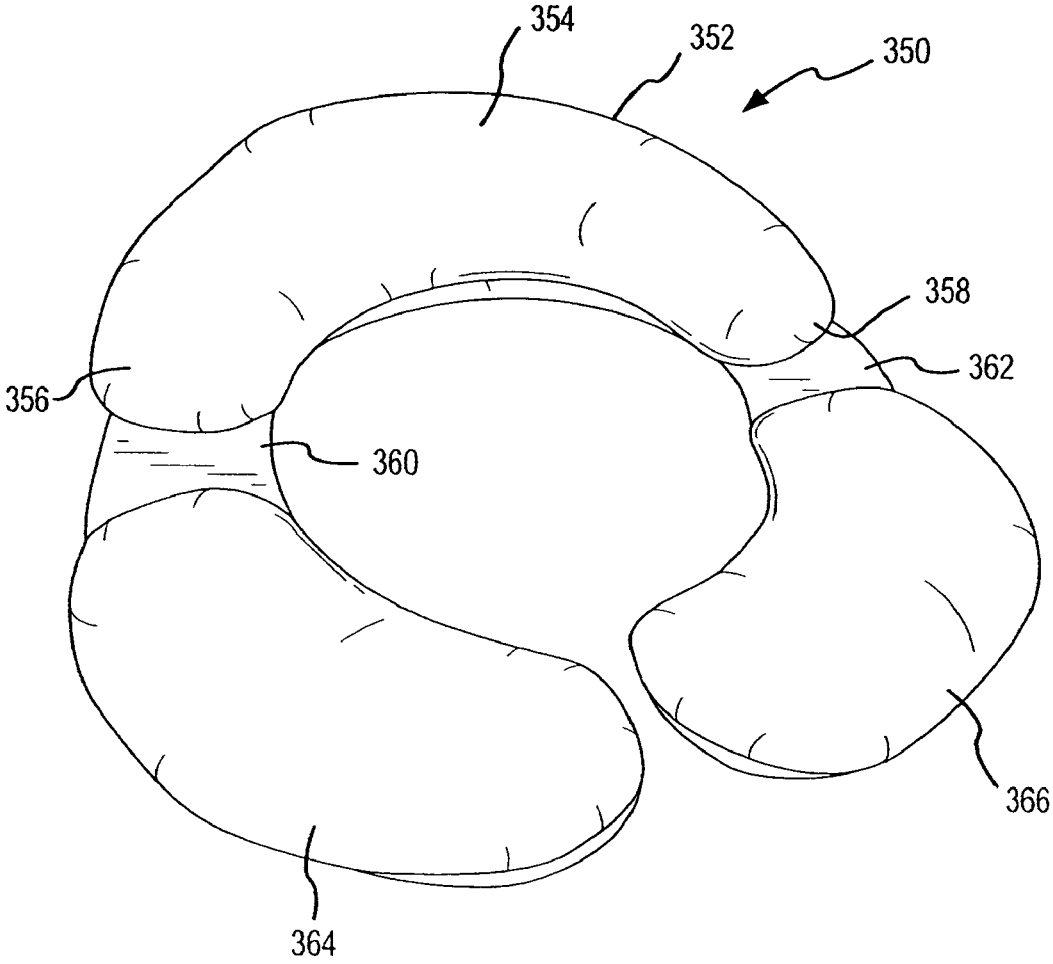
FIG. 28 illustrates another embodiment of a pillow system having a main pillow and two attached pillows according to the invention.

Referring now to FIG. 28, another embodiment of a pillow system 350 will be described. Pillow system 358 comprises a main pillow 352 having a medial region 354 and a pair of ends 356 and 350. Main pillow 352 may be constructed similar to any of the pillows described herein. Optionally, main pillow 352 could also be used with any of the padded attachment members described herein. Ends 356 and 358 each include a fabric extension 360 and 362 that attach main pillow 352 to a pair of lower back pillows 364 and 366. In this way, pillows 364 and 366 are permanently attached to main pillow 352. However, it will be appreciated that lower back pillows 364 and 366 could be removably attached in a manner similar to other embodiments described herein. Also, although shown with two lower back pillows, it will be appreciated that only a single lower back pillow could be attached.

Pillow system 350 has a variety of uses. In one application, both lower back pillows 364 and 366 could be placed adjacent the lower back while main pillow 352 is at the user's stomach. In another application, one or both of lower back pillows 364 or 366 could be folded over so as to rest on top of or below main pillow 352. In this way, one or both of the lower back pillows could be used to vary the height and/or angle of the main pillow. Or, one could be used to vary the height of the main pillow while the other supports the lower back.

The lower back pillows 364 and 366 may have a size and shape that are similar to the other back support pillows described herein. Alternatively the lower back pillow could be smaller in size or have different shapes so that both could fit behind the back in tandem.

FIGS. 29-37 illustrates various other types of pillow systems having a main pillow and one or two attached side or auxiliary pillows. These pillows may be used in any of the ways described in connection with the other pillows described herein.

Figure 29:
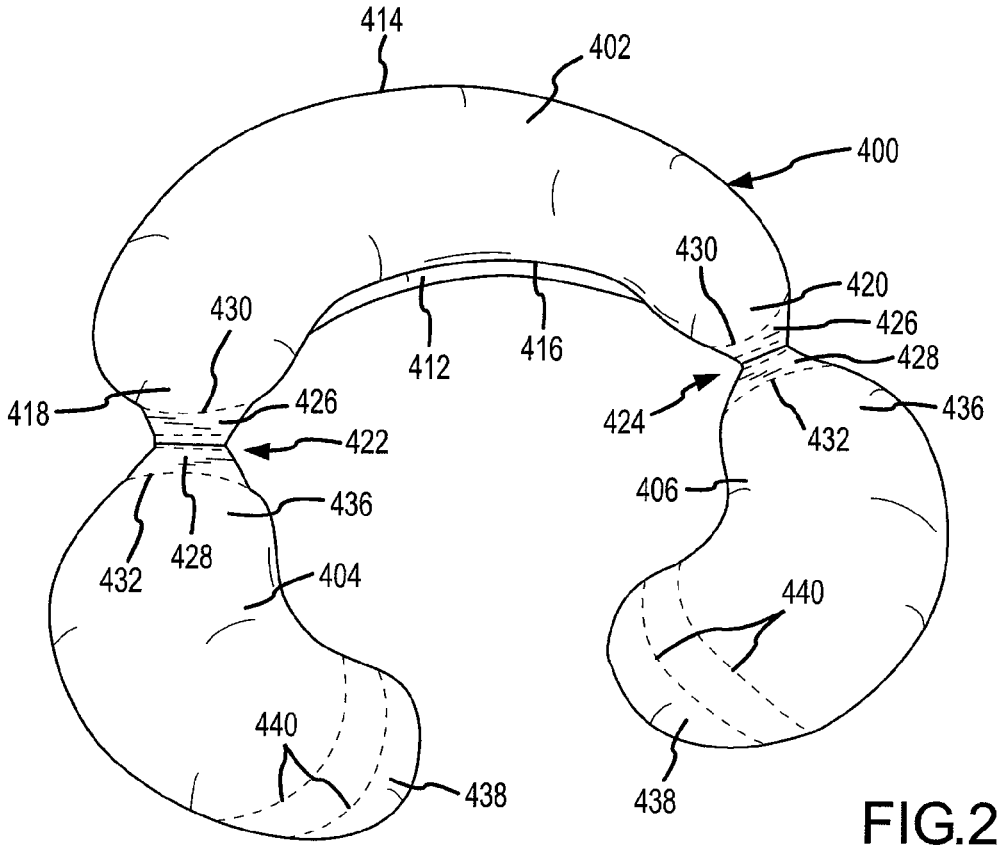
FIG. 29 illustrates one particular embodiment of a pillow system having a main pillow and two attached pillows with tapered ends according to the invention.

FIG. 29 describes a pillow system 400 having a main pillow 402 and two attached auxiliary pillows 404 and 406, although only one could be used. Main pillow 402 may be constructed of an outer shell covering a fill material similar to the other embodiments described herein. The outer shell may be constructed of a top curved piece 408 a lower bottom piece 410 (see FIG. 30) and an inner gusset 412. Gusset 412 allows the ends of main pillow 402 to be separated further from each other as described generally in U.S. Pat. Nos. 6,279,185 and 6,412,128, the complete disclosures of which are herein incorporated by reference. Gusset 412 may have a width in the range from about 1 inch to about 6 inches.

For convenience of discussion, pillow 402 may be described in terms of an outer periphery 414, an inner periphery 416 and two curved ends 418 and 420. Coupled to ends 418 and 420 are auxiliary pillows 404 and 406, which have a variety of uses, such as supporting the user's lower back, adjusting the height of the main pillow and/or facilitating the support of an item. Pillows 404 and 406 may be coupled to main pillow 420 by using fabric connectors 422 and 424. Each of the fabric connectors may be fabricated using two fabric sections 426 and 428 that are sewn together, and also sewn to center seams 430 and 432 in main pillow 402 and auxiliary pillows 404 and 406 (see also FIG. 30). This permits auxiliary pillows 404 and 406 to be separately folded on top of main pillow 402 as shown in FIG. 31.

One feature of auxiliary pillows 404 and 406 is that may be configured to taper down in height from an inner end 436 to an outer end 438. This provides a wide variety of features. For example, both auxiliary pillows 404 and 406 may be folded on top of main pillow 402 to increase the height of main pillow 402. By tapering both pillow 404 and 406, the resulting surface on top of main pillow 402 is generally flat. As another example, one of the auxiliary pillows 404 or 406 may be folded on top of main pillow 402 while the other remains extended. This increases the height of the main pillow while also providing a gently sloping surface down the main pillow 402 and the extended auxiliary pillow. Such a gently sloping surface is particularly useful when nursing a baby. The elevated nature of the main pillow places the baby's head closer to the baby's breast, while the sloping surface provides comfort to the baby and assists in digestion since the baby's stomach will be below the head. When the mother is ready feed from the other side, the extending auxiliary pillow may be placed on top of main pillow 402, while the other auxiliary pillow is extended. In this way, the extended auxiliary pillow may also be used to support the mother's lower back.

One way to taper pillows 404 and 406 is by using sew lines or stitching. Similar to main pillow 402, auxiliary pillows 404 and 406 may be constructed of an outer shell which encases a fill material. A pair of curved sew lines 440 are sewn completely through the fill material so that outer shell is sewn to itself. The distance between the sew lines determines the amount of taper. Also, although shown with two sew lines which are curved, it will be appreciated that other numbers and/or shapes may be used as described hereinafter.

Figure 30:
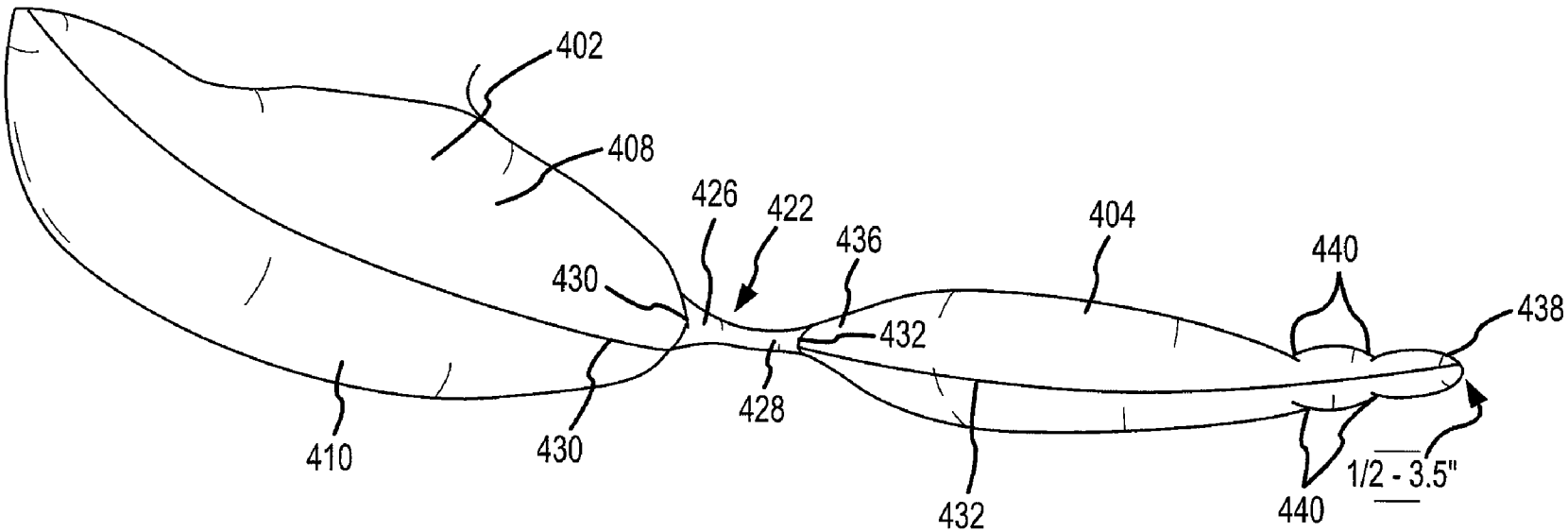
FIG. 30 is a side view of the pillow system of FIG. 29.
Figure 31:
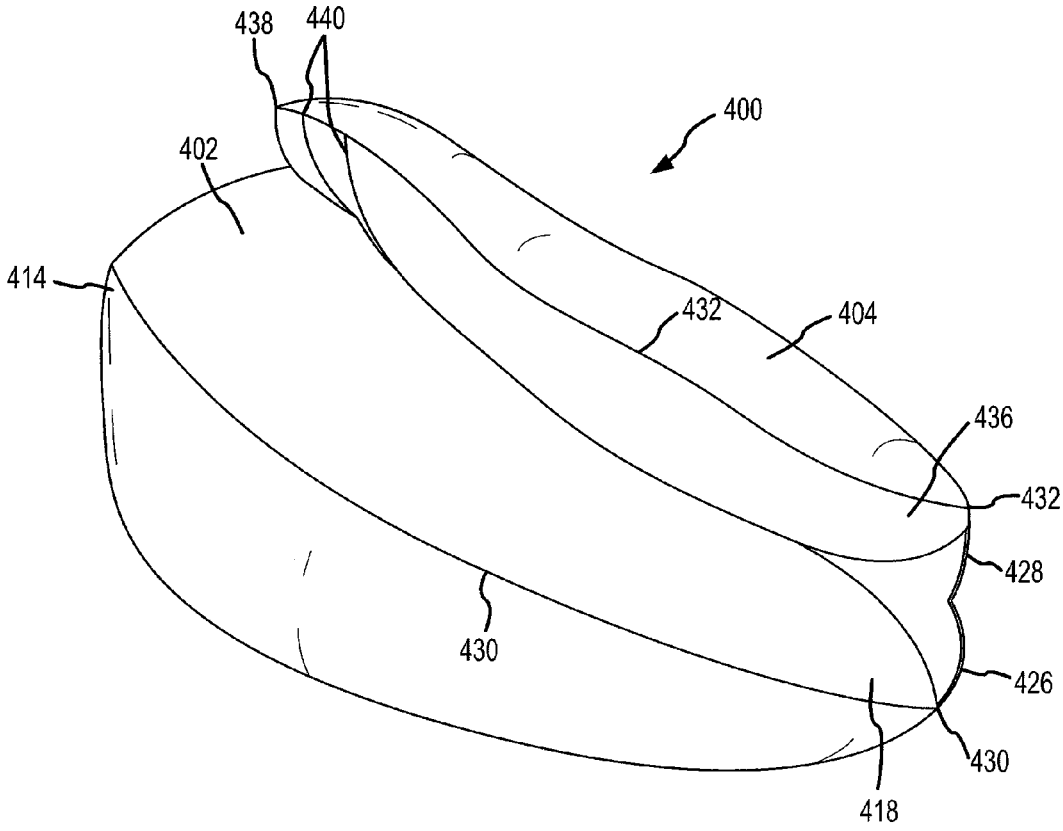
FIG. 31 illustrates the pillow system of FIG. 30, with one of the attached pillows folded on top of the main pillow.

As best shown in FIG. 30, the amount of taper in the height can vary from 6 inches to about 0.5 inches for each of pillows 404 and 406. In one specific embodiment, inner portion 436 may have a height in the range from about 2 inches to about 6 inches, while the outer portion 438 may have a height in the range from about 0.5 inches to about 3.5 inches. Also, the main pillow 402 may have a maximum height that is in the range from about 3 inches to about 8 inches. Further, main pillow 402 and be separated from auxiliary pillows 404 and 406 by a distance in the range from about 3 inches to about 5 inches. This is the length of connectors 422 and 424.

Figure 32:
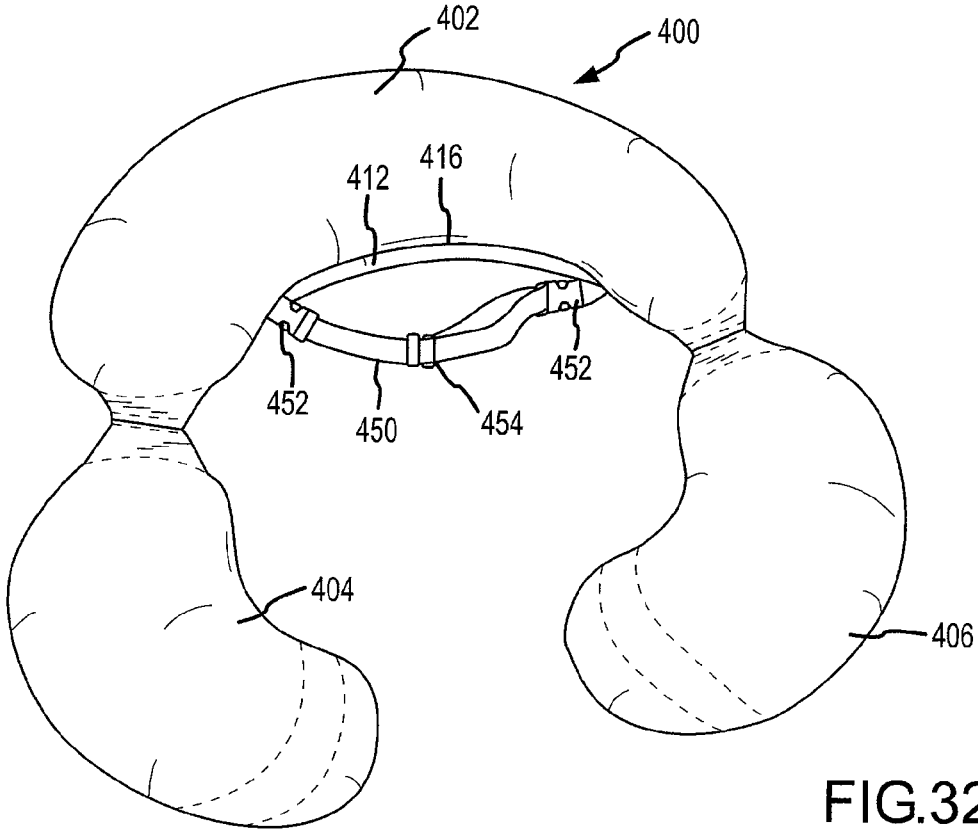
FIG. 32 illustrates the pillow system of FIG. 29 with a belt according to the invention.

Optionally, pillow system 400 may also include a belt 450 as illustrated in FIG. 32. Belt 450 is connected to pillow 402 at inner periphery 416 and may optionally be connected to gusset 412. This may be accomplished by sewing connectors 452 to gusset 412 and then coupling belt 450 to connectors 452. Also, it will be appreciated that a variety of connectors could be used, such as interlocking connectors, snaps, buttons, a hook and loop fastener material, and the like. An adjustment mechanism 454 may be used to adjust the length of belt 450.

Belt 450 permits pillow 402 to be secured about a person's midsection. For example, when inner periphery 416 is adjacent a user's stomach, belt 450 may extend around the user's back to help hold pillow 402 against the user's stomach.

Figure 33:
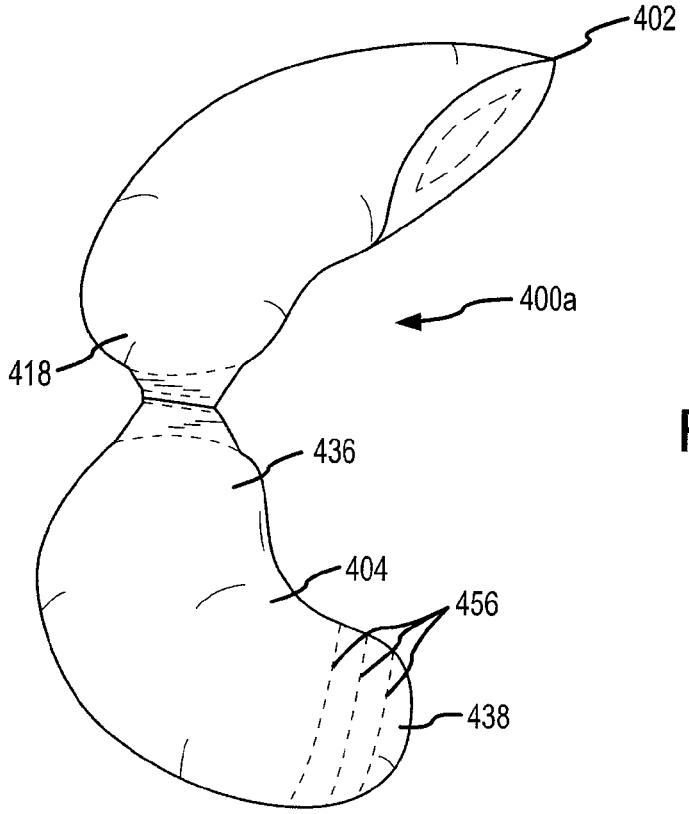
FIG. 33 illustrates a portion of an alternative pillow system having three straight sew lines according to the invention.

FIG. 33 illustrates an alternative pillow system 400*a*. Pillow system 400*a* is similar to pillow system 400 except that it includes three straight sew lines 456. For convenience of discussion, pillow system 400*a* will use the same reference numerals used to describe pillow system 400. Sew lines 456 may be placed at end 438 of each of the auxiliary pillows and may be used to taper the height of the auxiliary pillows in a manner similar to that previously described.

Figure 34:
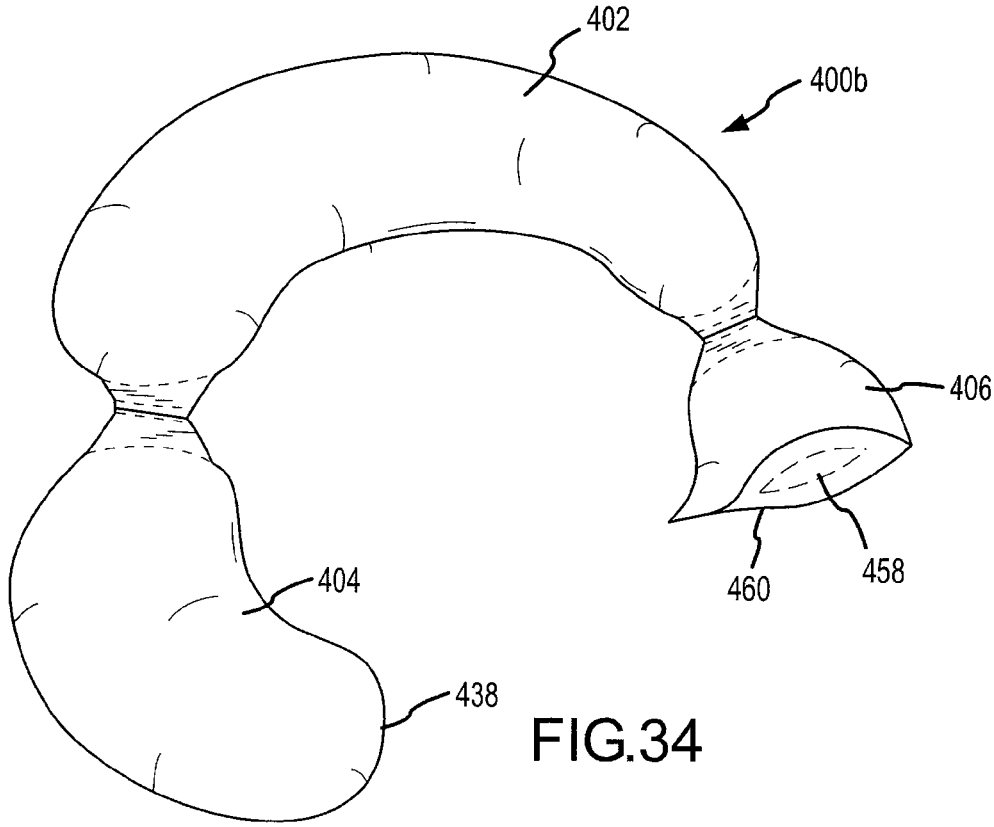
FIG. 34 illustrates a portion of another pillow system without sew lines or a gusset according to the invention.

FIG. 34 illustrates an alternative pillow system 400*b*. Pillow system 400*b* is similar to pillow system 400 except that it includes no sew lines at end 438. For convenience of discussion, pillow system 400*b* will use the same reference numerals used to describe pillow system 400. To provide any tapering in height, less fill material 458 may be provided within the fabric shell 460 at end 438. Also, pillow system 400*b* differs from pillow system 400 in that pillow system 400*b* does not include a gusset.

Figure 35:
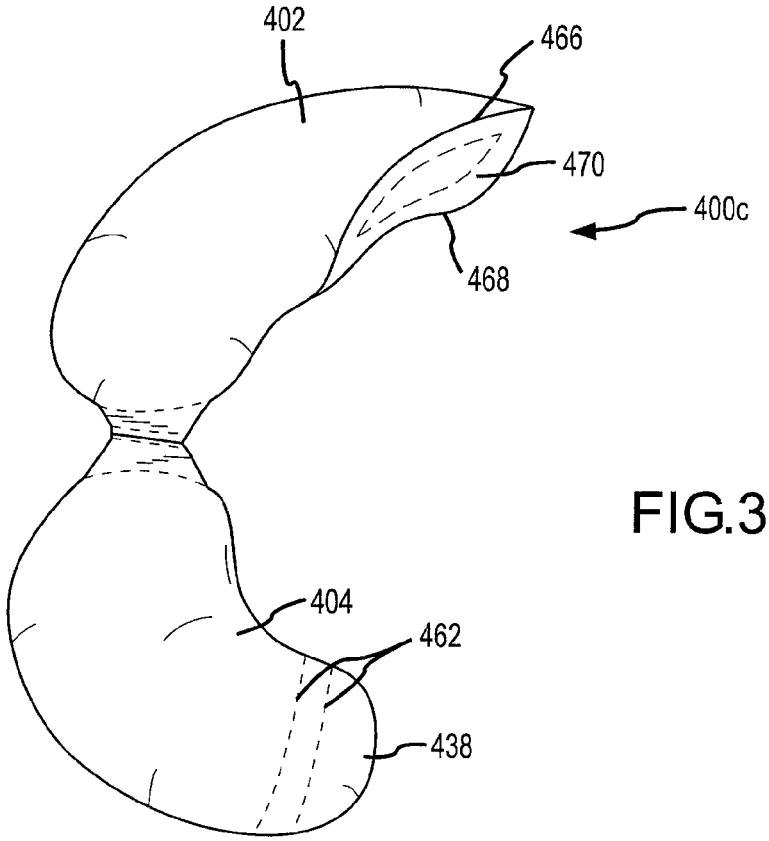
FIG. 35 illustrates a portion of a further pillow system having two straight sew lines according to the invention.

FIG. 35 illustrates an alternative pillow system 400*c*. Pillow system 400*c* is similar to pillow system 400 except that it includes two straight sew lines 462 at end 438. For convenience of discussion, pillow system 400*c* will use the same reference numerals used to describe pillow system 400. Also, pillow system 400*c* differs from pillow system 400 in that pillow system 400*c* does not include a gusset. Instead, two pieces of fabric 466 and 468 are sewn together and surround a fill material 470.

Figure 36:
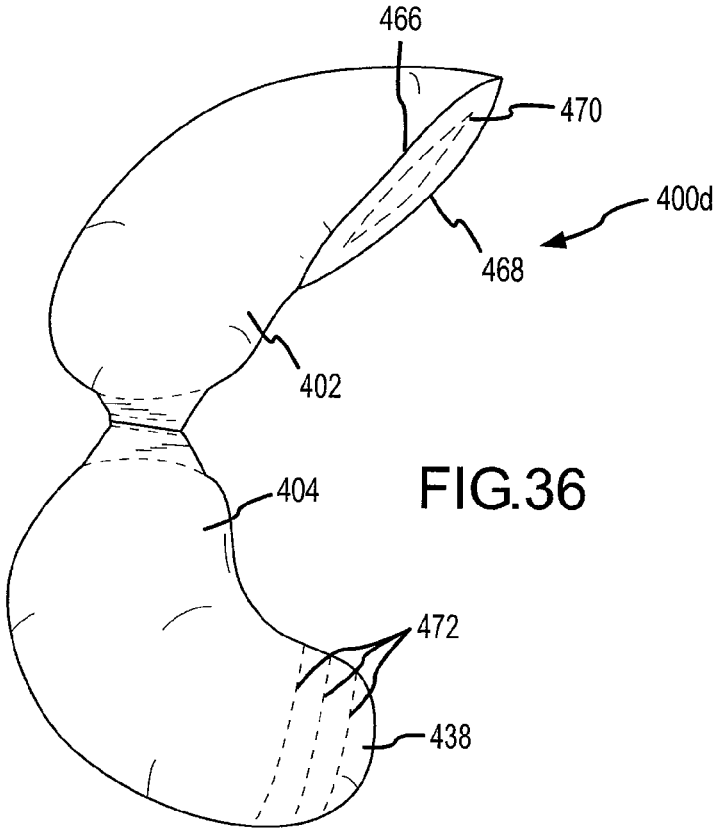
FIG. 36 illustrates yet another pillow system having three curved sew lines according to the invention.

FIG. 36 illustrates an alternative pillow system 400*d*. Pillow system 400*d* is similar to pillow system 400*c* except that it includes three curved sew lines 472 at end 438. For convenience of discussion, pillow system 400*d* will use the same reference numerals used to describe pillow system 400*c*.

Figure 37:
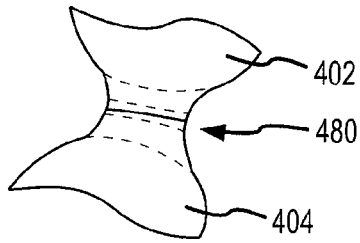
FIG. 37 illustrates an alternative arrangement for connecting a back pillow to the main pillow according to the invention.

In FIGS. 29-36, fabric connector 422 may have a V shaped outer periphery. As an alternative (as shown in FIG. 37), a fabric connector 480 may have a continuous curved outer periphery. In this way, connector 480 has an hour glass shape. This may be constructed of a single piece of fabric or multiple pieces of fabric.

The invention has now been described in detail for purposes of clarity and understanding. However it will be appreciated that certain changes and modifications may be practiced within the scope of the appended claims.

What is claimed is:

1. A pillow system comprising:

a curved main pillow comprising a pillow body having a midsection, an outer periphery, an inner periphery and a pair of ends configured such that the main pillow is positionable on a user's lap, with the inner periphery adjacent the user's stomach and the ends wrapped about the user's sides, wherein the midsection has a height that reduces toward each end; and a curved side pillow operably attached to one of the ends of the main pillow such that the side pillow is positionable away from the main pillow or on top of the main pillow, and wherein the side pillow has a midsection, an outer periphery, an inner periphery an inner end near the main pillow and an outer end away from the main pillow when the side pillow is positioned away from the main pillow, and wherein the side pillow tapers downward in height from the inner end to the outer end;

wherein the side pillow is foldable on top of the main pillow while remaining attached to the main pillow at the inner end such that the inner end is generally aligned with one of the ends of the main pillow and the outer end is positioned near the midsection of the main pillow, and wherein the tapered nature of the side pillow allows for a reduction in height of the overall pillow system at the midsection of the main pillow such that the resulting surface on top of the main pillow is generally flat.

2. A pillow system as in claim 1, further comprising a second curved side pillow operably attached to another one of the ends of the main pillow.

3. A pillow system as in claim 1, wherein the side pillow and the main pillow are operably attached with a piece of fabric to permit the side pillow to be folded back and placed on top of one of the ends of the main pillow.

4. A pillow system as in claim 1, wherein the side pillow includes at least one line of stitching near the outer end to taper the height.

5. A pillow system as in claim 4, wherein the line of stitching is selected from a group consisting of straight lines and curved lines.

6. A pillow system as in claim 1, wherein the side pillow is kidney bean shaped in geometry.

7. A pillow system as in claim 4, further comprising multiple lines of spaced apart stitching near the outer end of the side pillow.

8. A pillow system as in claim 3, wherein the fabric connector has an outer geometry selected from a group consisting of curved and intersecting straight lines.

9. A pillow system as in claim 1, further comprising a belt arrangement coupled to the inner periphery of the main pillow, wherein the belt arrangement is configured to secure the pillow system to a user's midsection.

10. A pillow system as in claim 1, wherein the main pillow comprises an outer fabric covering a fill material, and wherein the outer fabric includes a gusset at the inner periphery to permit the ends of the main pillow to be further separated from each other.

11. A pillow system as in claim 10, wherein the gusset has a width in the range from about 1 inch to about 6 inches.

12. A pillow system as in claim 1, wherein the side pillow comprises a fill material enclosed within a fabric shell.

13. A method for supporting an item, comprising:

providing a curved main pillow comprising a pillow body having a midsection, an outer periphery, an inner periphery and a pair of ends, and at least one curved side pillow operably attached to one of the ends of the main pillow, and wherein the side pillow has a midsection, an outer periphery, an inner periphery an inner end near the main pillow and an outer end away from the main pillow, and wherein the side pillow tapers downward in height from the inner end to the outer end;

placing the main pillow onto a lap of a user who is sitting down, with the midsection being adjacent the user's stomach and with the ends extending around the user's sides; and supporting an item using the main pillow; and further comprising folding the side pillow on top of the main pillow and resting the item on the side pillow, with the item sloping down due to the taper of the side pillow.

14. A method as in claim 13, further comprising positioning the side pillow adjacent to the user's side and lower back.

15. A method as in claim 13, wherein the item comprises a baby, and further comprising nursing or feeding the baby while being supported by the pillow.

16. A method as in claim 13, further comprising a second side pillow that is operably attached to the other end of the main pillow, and placing the second side pillow around the user while the other side pillow is on top of the main pillow.

17. A method as in claim 13, further comprising a second side pillow that is operably attached to the other end of the main pillow, and placing the second side pillow on top of the other side pillow which is folded on top of the main pillow.

18. A pillow system comprising:

a curved main pillow comprising a pillow body having a midsection, an outer periphery, an inner periphery and a pair of ends configured such that the main pillow is positionable on a user's lap, with the inner periphery adjacent the user's stomach and the ends wrapped about the user's sides, wherein the midsection has a height that gradually reduces toward each end, thereby forming an apex at the midsection; and a curved side pillow operably attached to one of the ends of the main pillow such that the side pillow is positionable at the user's back when the main pillow is placed adjacent to the user's stomach, and wherein the side pillow has a midsection, an outer periphery, an inner periphery an inner end near the main pillow and an outer end away from the main pillow, and wherein the side pillow tapers downward in height from the inner end to the outer end, wherein the inner end has a height in the range from about 6 inches to about 2 inches and the outer end has a height in the range from about 0.5 inches to about 3 inches;

and wherein the side pillow is foldable on top of the main pillow while remaining attached to the main pillow at the inner portion such that the inner portion is generally aligned with one of the ends of the main pillow and the outer portion is positioned near the midsection of the main pillow, and wherein the tapered nature of the side pillow allows for a reduction in height of the overall pillow system at the midsection of the main pillow such that the resulting surface on top of the main pillow is generally flat.

19. A pillow system as in claim 18, wherein the side pillow includes at least one line of stitching near the outer end to taper the height.

20. A pillow system as in claim 18, wherein the side pillow is kidney bean shaped in geometry.

21. A pillow system as in claim 19, wherein the line of stitching is selected from a group consisting of straight lines and curved lines.

22. A pillow system as in claim 18, further comprising multiple lines of spaced apart stitching near the outer end of the side pillow.

* * * * *